US009127527B2

(12) United States Patent
Frazier

(10) Patent No.: US 9,127,527 B2
(45) Date of Patent: Sep. 8, 2015

(54) DECOMPOSABLE IMPEDIMENTS FOR DOWNHOLE TOOLS AND METHODS FOR USING SAME

(71) Applicant: W. Lynn Frazier, Corpus Christi, TX (US)

(72) Inventor: W. Lynn Frazier, Corpus Christi, TX (US)

( * ) Notice: Subject to any disclaimer, the term of this patent is extended or adjusted under 35 U.S.C. 154(b) by 0 days.

(21) Appl. No.: 13/893,205

(22) Filed: May 13, 2013

(65) Prior Publication Data

US 2013/0240203 A1 Sep. 19, 2013

Related U.S. Application Data

(63) Continuation-in-part of application No. 13/194,820, filed on Jul. 29, 2011, and a continuation-in-part of application No. 12/799,231, filed on Apr. 21, 2010, now abandoned.

(60) Provisional application No. 61/214,347, filed on Apr. 21, 2009.

(51) Int. Cl.
*E21B 33/12* (2006.01)
*E21B 33/129* (2006.01)
(Continued)

(52) U.S. Cl.
CPC ..... *E21B 33/12* (2013.01); *E21B 33/129* (2013.01); *E21B 33/134* (2013.01); *E21B 34/063* (2013.01); *E21B 34/14* (2013.01)

(58) Field of Classification Search
CPC ..... E21B 23/06; E21B 33/129; E21B 33/134; E21B 33/12; E21B 34/14; E21B 34/063
USPC ..... 166/123, 135, 118, 138, 192, 133
See application file for complete search history.

(56) References Cited

U.S. PATENT DOCUMENTS 1,476,727 A 12/1923 Quigg
RE17,217 E 2/1929 Burch
(Continued)

FOREIGN PATENT DOCUMENTS

GB 914030 12/1962
WO WO0283661 A1 10/2002
(Continued)

OTHER PUBLICATIONS

"Teledyne Merla Oil Tools—Products—Services," Teledyne Merla, Aug. 1990 (40 pages).
(Continued)

*Primary Examiner* — Robert E Fuller
(74) *Attorney, Agent, or Firm* — Edmonds & Nolte, P.C.

(57) ABSTRACT

A plug for isolating a wellbore. The plug can include a mandrel having a bore formed therethrough, at least one sealing element disposed about the mandrel, at least one slip disposed about the mandrel, at least one conical member disposed about the mandrel, and an insert disposed at least partially within the bore of the mandrel. The insert can include a body, at least one circumferential groove disposed on an outer surface of the body, wherein the at least one circumferential groove is adapted to retain an elastomeric seal, and at least one interface disposed on an end of the body for securing the insert into the mandrel. The body can also have a bore formed only partially therethrough or a bore formed completely therethrough with the body being adapted to receive an impediment that restricts fluid flow in at least one direction through the body. At least one of the body and the impediment can include one or more decomposable materials.

31 Claims, 7 Drawing Sheets

(51) Int. Cl.

| | |
|---|---|
| ***E21B 33/134*** | (2006.01) |
| ***E21B 34/06*** | (2006.01) |
| ***E21B 34/14*** | (2006.01) |

(56) References Cited

U.S. PATENT DOCUMENTS

| | | | | |
|---|---|---|---|---|
| 2,040,889 | A | | 5/1936 | Whinnen |
| 2,160,228 | A | | 5/1939 | Pustmueller |
| 2,223,602 | A | | 12/1940 | Cox |
| 2,230,447 | A | | 2/1941 | Bassinger |
| 2,286,126 | A | | 6/1942 | Thornhill |
| 2,331,532 | A | | 10/1943 | Bassinger |
| 2,376,605 | A | | 5/1945 | Lawrence |
| 2,555,627 | A | | 6/1951 | Baker |
| 2,589,506 | A | | 3/1952 | Morrisett |
| 2,593,520 | A | | 4/1952 | Baker et al. |
| 2,616,502 | A | | 11/1952 | Lenz |
| 2,630,865 | A | | 3/1953 | Baker |
| 2,637,402 | A | | 5/1953 | Baker et al. |
| 2,640,546 | A | | 6/1953 | Baker |
| 2,671,512 | A | | 3/1954 | Ragan et al. |
| 2,695,068 | A | * | 11/1954 | Baker et al. ..... 277/338 |
| 2,713,910 | A | | 7/1955 | Baker et al. |
| 2,714,932 | A | | 8/1955 | Thompson |
| 2,737,242 | A | | 3/1956 | Baker |
| 2,756,827 | A | | 7/1956 | Farrar |
| 2,815,816 | A | | 12/1957 | Baker |
| 2,830,666 | A | | 4/1958 | Rhodes |
| 2,833,354 | A | | 5/1958 | Sailers |
| 3,013,612 | A | | 12/1961 | Angel |
| 3,054,453 | A | | 9/1962 | Bonner |
| 3,062,296 | A | | 11/1962 | Brown |
| 3,082,824 | A | | 3/1963 | Taylor |
| 3,094,166 | A | | 6/1963 | McCullough |
| 3,160,209 | A | | 12/1964 | Bonner |
| 3,163,225 | A | | 12/1964 | Perkins |
| 3,270,819 | A | | 9/1966 | Thrane et al. |
| 3,273,588 | A | | 9/1966 | Dollison |
| 3,282,342 | A | | 11/1966 | Mott |
| 3,291,218 | A | | 12/1966 | Lebourg |
| 3,298,437 | A | | 1/1967 | Conrad |
| 3,298,440 | A | | 1/1967 | Current |
| 3,306,362 | A | | 2/1967 | Urbanosky |
| 3,308,895 | A | | 3/1967 | Oxford et al. |
| 3,356,140 | A | | 12/1967 | Young |
| 3,387,660 | A | | 6/1968 | Berryman |
| 3,393,743 | A | | 7/1968 | Stanescu |
| 3,429,375 | A | | 2/1969 | Craig |
| 3,517,742 | A | | 6/1970 | Williams |
| 3,554,280 | A | | 1/1971 | Tucker |
| 3,602,305 | A | | 8/1971 | Kisling |
| 3,623,551 | A | | 11/1971 | Randermann, Jr. |
| 3,687,202 | A | | 8/1972 | Young et al. |
| 3,787,101 | A | | 1/1974 | Sugden |
| 3,818,987 | A | | 6/1974 | Ellis |
| 3,851,706 | A | | 12/1974 | Ellis |
| 3,860,066 | A | | 1/1975 | Pearce et al. |
| 3,926,253 | A | | 12/1975 | Duke |
| 4,035,024 | A | | 7/1977 | Fink |
| 4,049,015 | A | | 9/1977 | Brown |
| 4,134,455 | A | | 1/1979 | Read |
| 4,151,875 | A | | 5/1979 | Sullaway |
| 4,185,689 | A | | 1/1980 | Harris |
| 4,189,183 | A | | 2/1980 | Borowski |
| 4,250,960 | A | | 2/1981 | Chammas |
| 4,281,840 | A | | 8/1981 | Harris |
| 4,314,608 | A | | 2/1982 | Richardson |
| 4,381,038 | A | | 4/1983 | Sugden |
| 4,391,547 | A | | 7/1983 | Jackson, Jr. et al. |
| 4,405,017 | A | | 9/1983 | Allen et al. |
| 4,432,418 | A | | 2/1984 | Mayland |
| 4,436,151 | A | | 3/1984 | Callihan et al. |
| 4,437,516 | A | | 3/1984 | Cockrell |
| 4,457,376 | A | | 7/1984 | Carmody et al. |
| 4,493,374 | A | | 1/1985 | Magee, Jr. |
| 4,532,995 | A | | 8/1985 | Kaufman |
| 4,548,442 | A | | 10/1985 | Sugden et al. |
| 4,554,981 | A | | 11/1985 | Davies |
| 4,566,541 | A | | 1/1986 | Moussy et al. |
| 4,585,067 | A | | 4/1986 | Blizzard et al. |
| 4,595,052 | A | | 6/1986 | Kristiansen |
| 4,602,654 | A | | 7/1986 | Stehling et al. |
| 4,688,641 | A | | 8/1987 | Knieriemen |
| 4,708,163 | A | | 11/1987 | Deaton |
| 4,708,202 | A | | 11/1987 | Sukup et al. |
| D293,798 | S | | 1/1988 | Johnson |
| 4,776,410 | A | | 10/1988 | Perkin et al. |
| 4,784,226 | A | | 11/1988 | Wyatt |
| 4,792,000 | A | | 12/1988 | Perkin et al. |
| 4,830,103 | A | | 5/1989 | Blackwell et al. |
| 4,848,459 | A | | 7/1989 | Blackwell et al. |
| 4,893,678 | A | | 1/1990 | Stokley et al. |
| 4,898,245 | A | | 2/1990 | Braddick |
| 5,020,590 | A | | 6/1991 | McLeod |
| 5,074,063 | A | | 12/1991 | Vannette |
| 5,082,061 | A | | 1/1992 | Dollison |
| 5,095,980 | A | | 3/1992 | Watson |
| 5,113,940 | A | | 5/1992 | Glaser |
| 5,117,915 | A | | 6/1992 | Mueller et al. |
| 5,154,228 | A | | 10/1992 | Gambertoglio et al. |
| 5,183,068 | A | | 2/1993 | Prosser |
| 5,188,182 | A | | 2/1993 | Echols, III et al. |
| 5,207,274 | A | | 5/1993 | Streich et al. |
| 5,209,310 | A | | 5/1993 | Clydesdale |
| 5,216,050 | A | * | 6/1993 | Sinclair ..... 524/108 |
| 5,219,380 | A | | 6/1993 | Young et al. |
| 5,224,540 | A | | 7/1993 | Streich et al. |
| 5,230,390 | A | | 7/1993 | Zastresek et al. |
| 5,234,052 | A | | 8/1993 | Coone et al. |
| 5,253,705 | A | | 10/1993 | Clary et al. |
| 5,271,468 | A | | 12/1993 | Streich et al. |
| 5,295,735 | A | | 3/1994 | Cobbs et al. |
| 5,311,939 | A | | 5/1994 | Pringle et al. |
| 5,316,081 | A | | 5/1994 | Baski et al. |
| 5,318,131 | A | | 6/1994 | Baker |
| D350,887 | S | | 9/1994 | Sjolander et al. |
| 5,343,954 | A | | 9/1994 | Bohlen et al. |
| D353,756 | S | | 12/1994 | Graves |
| D355,428 | S | | 2/1995 | Hatcher |
| 5,390,737 | A | | 2/1995 | Jacobi et al. |
| 5,392,540 | A | | 2/1995 | Cooper et al. |
| 5,419,399 | A | | 5/1995 | Smith |
| RE35,088 | E | | 11/1995 | Gilbert |
| 5,484,191 | A | | 1/1996 | Sollami |
| 5,490,339 | A | | 2/1996 | Accettola |
| 5,540,279 | A | | 7/1996 | Branch et al. |
| 5,564,502 | A | | 10/1996 | Crow et al. |
| 5,593,292 | A | | 1/1997 | Ivey |
| D377,969 | S | | 2/1997 | Grantham |
| 5,655,614 | A | | 8/1997 | Azar |
| 5,688,586 | A | | 11/1997 | Shiiki et al. |
| 5,701,959 | A | | 12/1997 | Hushbeck et al. |
| 5,785,135 | A | | 7/1998 | Crawley |
| 5,791,825 | A | | 8/1998 | Gardner et al. |
| 5,803,173 | A | | 9/1998 | Fraser, III et al. |
| 5,810,083 | A | | 9/1998 | Kilgore |
| 5,819,846 | A | | 10/1998 | Bolt, Jr. |
| 5,853,639 | A | | 12/1998 | Kawakami et al. |
| 5,908,917 | A | | 6/1999 | Kawakami et al. |
| D415,180 | S | | 10/1999 | Rosanwo |
| 5,961,185 | A | | 10/1999 | Friant et al. |
| 5,984,007 | A | | 11/1999 | Yuan et al. |
| 5,988,277 | A | | 11/1999 | Vick, Jr. et al. |
| 6,001,439 | A | | 12/1999 | Kawakami |
| 6,012,519 | A | | 1/2000 | Allen et al. |
| 6,046,251 | A | | 4/2000 | Kawakami |
| 6,082,451 | A | | 7/2000 | Giroux et al. |
| 6,085,446 | A | | 7/2000 | Posch |
| 6,098,716 | A | | 8/2000 | Hromas et al. |
| 6,105,694 | A | | 8/2000 | Scott |
| 6,142,226 | A | | 11/2000 | Vick |
| 6,152,232 | A | | 11/2000 | Webb et al. |
| 6,159,416 | A | | 12/2000 | Kawakami et al. |
| 6,167,963 | B1 | | 1/2001 | McMahon et al. |

(56) References Cited

U.S. PATENT DOCUMENTS 6,182,752 B1 2/2001 Smith, Jr. et al.
6,183,679 B1 2/2001 Kawakami
6,199,636 B1 3/2001 Harrison
6,220,349 B1 4/2001 Vargus et al.
6,245,437 B1 6/2001 Shiiki
6,283,148 B1 9/2001 Spears et al.
6,341,823 B1 1/2002 Sollami
6,367,569 B1 4/2002 Walk
6,394,180 B1 5/2002 Berscheidt et al.
6,457,267 B1 10/2002 Porter et al.
6,491,108 B1 12/2002 Slup et al.
6,543,963 B2 4/2003 Bruso
6,578,638 B2 6/2003 Guillory et al.
6,581,681 B1 6/2003 Zimmerman et al.
6,604,763 B1 8/2003 Cook et al.
6,629,563 B2 10/2003 Doane
6,673,403 B1 1/2004 Shiiki
6,695,049 B2 2/2004 Ostocke et al.
6,708,768 B2 3/2004 Slup et al.
6,708,770 B2 3/2004 Slup et al.
6,725,935 B2 4/2004 Szarka et al.
6,739,398 B1 5/2004 Yokley et al.
6,769,491 B2 8/2004 Zimmerman et al.
6,779,948 B2 8/2004 Bruso
6,796,376 B2 9/2004 Frazier
6,799,633 B2 10/2004 McGregor
6,834,717 B2 12/2004 Bland
6,851,489 B2 2/2005 Hinds
6,852,827 B2 2/2005 Yamane
6,854,201 B1 2/2005 Hunter et al.
6,891,048 B2 5/2005 Yamane
6,902,006 B2 6/2005 Myerley et al.
6,916,939 B2 7/2005 Yamane
6,918,439 B2 7/2005 Dallas
6,938,696 B2 9/2005 Dallas
6,944,977 B2 9/2005 Deniau et al.
6,951,956 B2 10/2005 Yamane
7,017,672 B2 3/2006 Owen
7,021,389 B2 4/2006 Bishop et al.
7,040,410 B2 5/2006 McGuire et al.
7,055,632 B2 6/2006 Dallas
7,069,997 B2 7/2006 Coyes et al.
7,107,875 B2 9/2006 Haugen et al.
7,124,831 B2 10/2006 Turley et al.
7,150,131 B2 12/2006 Barker
7,168,494 B2 1/2007 Starr et al.
7,235,673 B2 6/2007 Yamane
7,281,584 B2 10/2007 McGarian et al.
D560,109 S 1/2008 Huang
7,325,617 B2 2/2008 Murray
7,337,847 B2 3/2008 McGarian et al.
7,350,582 B2 * 4/2008 McKeachnie et al. ..... 166/373
7,353,879 B2 4/2008 Todd et al.
7,363,967 B2 4/2008 Burris et al.
7,373,973 B2 5/2008 Smith et al.
7,389,823 B2 6/2008 Turley et al.
7,428,922 B2 9/2008 Fripp et al.
7,501,464 B2 3/2009 Sato
7,527,104 B2 5/2009 Branch et al.
7,538,178 B2 5/2009 Sato
7,538,179 B2 5/2009 Sato
7,552,779 B2 6/2009 Murray
D597,110 S 7/2009 Anitua Aldecoa
7,600,572 B2 10/2009 Slup et al.
7,604,058 B2 10/2009 McGuire et al.
7,622,546 B2 11/2009 Sato
7,637,326 B2 12/2009 Bolding et al.
7,644,767 B2 1/2010 Kalb et al.
7,644,774 B2 1/2010 Branch et al.
D612,875 S 3/2010 Beynon
7,673,677 B2 3/2010 King et al.
7,690,436 B2 4/2010 Turley et al.
7,713,464 B2 5/2010 Nakajima
D618,715 S 6/2010 Corcoran
7,728,100 B2 6/2010 Sato
7,735,549 B1 6/2010 Nish et al.
7,740,079 B2 6/2010 Clayton et al.
7,775,286 B2 8/2010 Duphorne
7,775,291 B2 8/2010 Jacob et al.
7,781,600 B2 8/2010 Ogawa
7,784,550 B2 8/2010 Nutley et al.
7,785,682 B2 8/2010 Sato
7,798,236 B2 9/2010 McKeachnie et al.
7,799,837 B2 9/2010 Yamane
7,810,558 B2 10/2010 Shkurti et al.
7,812,181 B2 10/2010 Ogawa
D629,820 S 12/2010 Van Ryswyk
7,866,396 B2 1/2011 Rytlewski
7,878,242 B2 2/2011 Gray
7,886,830 B2 2/2011 Bolding et al.
7,900,696 B1 3/2011 Nish et al.
7,909,108 B2 3/2011 Swor et al.
7,909,109 B2 3/2011 Angman et al.
D635,429 S 4/2011 Hakki
7,918,278 B2 4/2011 Barbee
7,921,923 B2 4/2011 McGuire
7,921,925 B2 4/2011 Maguire et al.
7,926,571 B2 4/2011 Hofman
7,976,919 B2 7/2011 Sato
7,998,385 B2 8/2011 Yamane
8,003,721 B2 8/2011 Suzuki
8,039,548 B2 10/2011 Ogawa
8,074,718 B2 12/2011 Roberts
8,079,413 B2 12/2011 Frazier
8,104,539 B2 1/2012 Stanojcic et al.
8,113,276 B2 2/2012 Greenlee et al.
8,119,699 B2 2/2012 Yamane
8,127,856 B1 3/2012 Nish et al.
8,133,955 B2 3/2012 Sato
D657,807 S 4/2012 Frazier
8,163,866 B2 4/2012 Sato
8,230,925 B2 7/2012 Willberg et al.
8,231,947 B2 7/2012 Vaidya et al.
8,267,177 B1 * 9/2012 Vogel et al. ..... 166/317
8,293,826 B2 10/2012 Hokari
8,304,500 B2 11/2012 Sato
8,318,837 B2 11/2012 Sato et al.
8,362,158 B2 1/2013 Sato
8,404,868 B2 3/2013 Yamane
8,424,610 B2 4/2013 Newton
8,459,346 B2 6/2013 Frazier
8,496,052 B2 7/2013 Frazier
2001/0040035 A1 11/2001 Appleton et al.
2003/0024706 A1 2/2003 Allamon
2003/0188860 A1 10/2003 Zimmerman et al.
2004/0150533 A1 8/2004 Hall et al.
2005/0173126 A1 8/2005 Starr et al.
2005/0175801 A1 8/2005 Yamane
2006/0001283 A1 1/2006 Bakke
2006/0011389 A1 1/2006 Booth et al.
2006/0047088 A1 3/2006 Yamane
2006/0278405 A1 12/2006 Turley et al.
2007/0051521 A1 3/2007 Fike et al.
2007/0068670 A1 3/2007 Booth
2007/0107908 A1 5/2007 Vaidya et al.
2007/0151722 A1 7/2007 Lehr et al.
2007/0227745 A1 10/2007 Roberts et al.
2007/0240883 A1 10/2007 Telfer
2008/0060821 A1 3/2008 Smith et al.
2008/0110635 A1 5/2008 Loretz et al.
2009/0044957 A1 2/2009 Clayton et al.
2009/0081396 A1 3/2009 Hokari
2009/0114401 A1 5/2009 Purkis
2009/0126933 A1 5/2009 Telfer
2009/0211749 A1 8/2009 Nguyen et al.
2010/0064859 A1 3/2010 Stephens
2010/0084146 A1 4/2010 Roberts
2010/0093948 A1 4/2010 Sato
2010/0101807 A1 4/2010 Greenlee et al.
2010/0132960 A1 6/2010 Shkurti et al.
2010/0155050 A1 6/2010 Frazier
2010/0184891 A1 7/2010 Akutsu
2010/0215858 A1 8/2010 Yamane
2010/0252252 A1 10/2010 Harris et al.

(56) References Cited

U.S. PATENT DOCUMENTS

| | | | |
|---|---|---|---|
| 2010/0263876 | A1 | 10/2010 | Frazier |
| 2010/0276159 | A1 | 11/2010 | Mailand et al. |
| 2010/0286317 | A1 | 11/2010 | Sato |
| 2010/0288503 | A1 | 11/2010 | Cuiper et al. |
| 2011/0005779 | A1 | 1/2011 | Lembcke |
| 2011/0008578 | A1 | 1/2011 | Yamane |
| 2011/0027590 | A1 | 2/2011 | Abe |
| 2011/0036564 | A1 | 2/2011 | Williamson |
| 2011/0061856 | A1 | 3/2011 | Kellner et al. |
| 2011/0088915 | A1 | 4/2011 | Stanojcic et al. |
| 2011/0103915 | A1 | 5/2011 | Tedeschi |
| 2011/0104437 | A1 | 5/2011 | Yamamura |
| 2011/0108185 | A1 | 5/2011 | Hokari |
| 2011/0168404 | A1 | 7/2011 | Telfer et al. |
| 2011/0190456 | A1 | 8/2011 | Itoh |
| 2011/0198082 | A1 | 8/2011 | Stromquist et al. |
| 2011/0240295 | A1 | 10/2011 | Porter |
| 2011/0259610 | A1 | 10/2011 | Shkurti et al. |
| 2011/0263875 | A1 | 10/2011 | Suzuki |
| 2012/0046414 | A1 | 2/2012 | Sato |
| 2012/0086147 | A1 | 4/2012 | Sato |
| 2012/0125642 | A1 | 5/2012 | Chenault et al. |
| 2012/0130024 | A1 | 5/2012 | Sato |
| 2012/0156473 | A1 | 6/2012 | Suzuki |
| 2012/0193835 | A1 | 8/2012 | Suzuki |
| 2012/0270048 | A1 | 10/2012 | Saigusa |
| 2012/0289713 | A1 | 11/2012 | Suzuki |
| 2013/0079450 | A1 | 3/2013 | Sato |
| 2013/0081801 | A1 | 4/2013 | Liang |
| 2013/0081813 | A1 | 4/2013 | Liang |
| 2013/0087061 | A1 | 4/2013 | Marya |

FOREIGN PATENT DOCUMENTS

| | | | |
|---|---|---|---|
| WO | WO0270508 | A3 | 12/2002 |
| WO | WO03006525 | A1 | 1/2003 |
| WO | WO03006526 | A1 | 1/2003 |
| WO | WO03074092 | A1 | 9/2003 |
| WO | WO03090438 | A1 | 10/2003 |
| WO | WO03099562 | A1 | 12/2003 |
| WO | WO2004033527 | A1 | 4/2004 |
| WO | WO03037956 | A1 | 5/2004 |
| WO | WO2005044894 | A1 | 5/2005 |
| WO | WO2005044984 | A1 | 5/2005 |
| WO | WO2006064611 | A1 | 1/2006 |
| WO | WO2010127457 | | 11/2010 |

OTHER PUBLICATIONS

"78/79 Catalog: Packers—Plugs —Completions Tools," Pengo Industires, Inc., 1978-1979 (12 pages).
"MAP Oil Tools Inc. Catalog," MAP Oil Tools, Apr. 1999 (46 pages).
"Lovejoy—where the world turns for couplings," Lovejoy, Inc., Dec. 2000 (30 pages).
"Halliburton Services, Sales & Service Catalog," Halliburton Services, 1970-1971 (2 pages).
"1975-1976 Packer Catalog," Gearhart-Owen Industries Inc., 1975-1976 (52 pages).
"Formation Damage Control Utilizing Composite-Bridge Plug Technology for Monobore, Multizone Stimulation Operations," Gary Garfield, SPE, May 15, 2001 (8 pages).
"Composite Bridge Plug Technique for Multizone Commingled Gas Wells," Gary Garfield, SPE, Mar. 24, 2001 (6 pages).
"Composite Research: Composite bridge plugs used in multi-zone wells to avoid costly kill-weight fluids," Gary Garfield, SPE, Mar. 24, 2001 (4 pages).
"It's About Time—Quick Drill Composite Bridge Plug," Baker Oil Tools, Jun. 2002 (2 pages).
"Baker Hughes—Baker Oil Tools—Workover Systems—QUIK Drill Composite Bride Plug," Baker Oil Tools, Dec. 2000 (3 pages).
"Baker Hughes 100 Years of Service,"Baker Hushes in Depth, Special Centennial Issue, Publication COR-07-13127, vol. 13, No. 2, Baker Hughes Incorporated, Jul. 2007 (92 pages).
"Halliburton Services, Sales & Service Catalog No. 43," Halliburton Co., 1985 (202 pages).
"Alpha Oil Tools Catalog," Alpha Oil Tools, 1997 (136 pages).
"78/79 Catalog: Packers—Plugs—Completions Tools," Pengo Industires, Inc., 1978-1979 (12 pages).
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 6, Notice of Filing IPR entered Apr. 2, 2013.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 31, Final Written Decision entered Sep. 2, 2014.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 33, Decision on Request for Rehearing entered Oct. 29, 2014.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 35, Notice of Appeal entered Dec. 23, 2014.
Petition for Inter Partes Review for U.S. Pat. No. 8,459,346 (U.S. Appl. No. 13/329,077); Case No. 2014-00993; Filed Jun. 19, 2014; Administrative Patent Judge Sally C. Medley; Paper No. 14, Decision to Institute Trial entered Dec. 1, 2014.
Petition for Inter Partes Review for U.S. Pat. No. 8,459,346 (U.S. Appl. No. 13/329,077); Case No. 2014-00993; Filed Jun. 19, 2014; Administrative Patent Judge Sally C. Medley; Paper No. 18, Termination of the Proceeding entered Dec. 11, 2014.

* cited by examiner

DECOMPOSABLE IMPEDIMENTS FOR DOWNHOLE TOOLS AND METHODS FOR USING SAME

CROSS-REFERENCE TO RELATED APPLICATIONS

This application is a continuation-in-part of U.S. patent application having Ser. No. 13/194,820, filed Jul. 29, 2011, which is a continuation-in-part of U.S. patent application having Ser. No. 12/799,231, filed Apr. 21, 2010, which claims priority to U.S. Provisional Patent Application having Ser. No. 61/214,347, filed Apr. 21, 2009. All of which are incorporated by reference herein in their entirety.

BACKGROUND

1. Field

Embodiments described generally relate to downhole tools. More particularly, embodiments described relate to an insert that can be engaged in downhole tools for controlling fluid flow through one or more zones of a wellbore.

2. Description of the Related Art

Bridge plugs, packers, and frac plugs are downhole tools that are typically used to permanently or temporarily isolate one wellbore zone from another. Such isolation is often necessary to pressure test, perforate, frac, or stimulate a zone of the wellbore without impacting or communicating with other zones within the wellbore. To reopen and/or restore fluid communication through the wellbore, plugs are typically removed or otherwise compromised.

Permanent, non-retrievable plugs and/or packers are typically drilled or milled to remove. Most non-retrievable plugs are constructed of a brittle material such as cast iron, cast aluminum, ceramics, or engineered composite materials, which can be drilled or milled Problems sometimes occur, however, during the removal or drilling of such non-retrievable plugs. For instance, the non-retrievable plug components can bind upon the drill bit, and rotate within the casing string. Such binding can result in extremely long drill-out times, excessive casing wear, or both. Long drill-out times are highly undesirable, as rig time is typically charged by the hour.

In use, non-retrievable plugs are designed to perform a particular function. A bridge plug, for example, is typically used to seal a wellbore such that fluid is prevented from flowing from one side of the bridge plug to the other. On the other hand, drop ball plugs allow for the temporary cessation of fluid flow in one direction, typically in the downhole direction, while allowing fluid flow in the other direction. Depending on user preference, one plug type may be advantageous over another, depending on the completion and/or production activity.

Certain completion and/or production activities may require several plugs run in series or several different plug types run in series. For example, one well may require three bridge plugs and five drop ball plugs, and another well may require two bridge plugs and ten drop ball plugs for similar completion and/or production activities. Within a given completion and/or production activity, the well may require several hundred plugs and/or packers depending on the productivity, depths, and geophysics of each well. The uncertainty in the types and numbers of plugs that might be required typically leads to the over-purchase and/or under-purchase of the appropriate types and numbers of plugs resulting in fiscal inefficiencies and/or field delays.

There is a need, therefore, for a downhole tool that can effectively seal the wellbore at wellbore conditions; be quickly, easily, and/or reliably removed from the wellbore; and configured in the field to perform one or more functions.

BRIEF DESCRIPTION OF THE DRAWINGS

Non-limiting, illustrative embodiments are depicted in the drawings, which are briefly described below. It is to be noted, however, that these illustrative drawings illustrate only typical embodiments and are not to be considered limiting of its scope, for the invention can admit to other equally effective embodiments.

DETAILED DESCRIPTION

An insert for use in a downhole plug is provided. The insert can include one or more upper shear or shearable mechanisms below a connection to a setting tool, and/or an insert for controlling fluid flow. The upper shear or shearable mechanism can be located directly on the first insert or on a separate component or second insert that is placed within the first insert. The upper shear or shearable mechanism is adapted to release a setting tool when exposed to a predetermined axial force that is sufficient to deform the shearable mechanism to release the setting tool but is less than an axial force sufficient to break the plug body. The terms "shear mechanism" and "shearable mechanism" are used interchangeably, and are intended to refer to any component, part, element, member, or thing that shears or is capable of shearing at a predetermined force that is less than the force required to shear the body of the plug. The term "shear" means to fracture, break, or otherwise deform thereby releasing two or more engaged components, parts, or things or thereby partially or fully separating a single component into two or more components/pieces. The term "plug" refers to any tool used to permanently or temporarily isolate one wellbore zone from another, including any tool with blind passages, plugged mandrels, as well as open passages extending completely therethrough and passages that are blocked with a check valve. Such tools are commonly referred to in the art as "bridge plugs," "frac plugs," and/or "packers." And, such tools can be a single assembly (i.e., one plug) or two or more assemblies (i.e., two or more plugs) disposed within a work string or otherwise connected thereto that is run into a wellbore on a wireline, slickline, production tubing, coiled tubing or any technique known or yet to be discovered in the art.

Further, a method for operating a wellbore is provided. The method can include operating the wellbore by setting one or more configurable plugs within the wellbore, with or without additionally using an insert to provide restricted fluid flow throughout the plug for a predetermined length of time.

Figure 1:
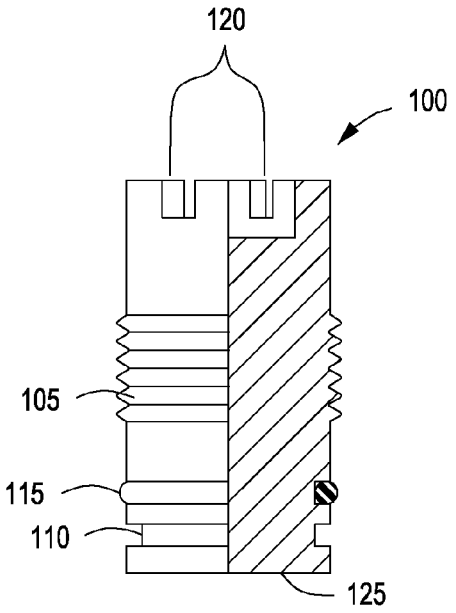
FIG. 1 depicts a partial section view of an illustrative insert for use with a plug for downhole use, according to one or more embodiments described.

FIG. 1 depicts a partial section view of an illustrative, insert 100 for a plug, according to one or more embodiments. The insert 100 can include a first or upper end 102 and a second or lower end 125. One or more threads 105 can be disposed or formed on an outer surface of the insert 100. The threads 105 can be disposed on the outer surface of the insert 100 toward the upper end 102. As discussed in more detail below with reference to FIGS. 6A, 6B, 6C, and 6D the threads 105 can be used to secure the insert 100 within a surrounding component, such as another insert 100, setting tool, tubing string, plug, or other tool.

Any number of outer threads 105 can be used. The number, pitch, pitch angle, and/or depth of outer threads 105 can depend at least in part, on the operating conditions of the wellbore where the insert 100 will be used. The number, pitch, pitch angle, and/or depth of the outer threads 105 can also depend, at least in part, on the materials of construction of both the insert 100 and the component, e.g., another insert 100, a setting tool, another tool, plug, tubing string, etc., to which the insert 100 is connected. The number of threads 105, for example, can range from about 2 to about 100, such as about 2 to about 50; about 3 to about 25; or about 4 to about 10. The number of threads 105 can also range from a low of about 2, 4, or 6 to a high of about 7, 12, or 20. The pitch between each thread 105 can also vary. The pitch between each thread 105 can be the same or different. For example, the pitch between each thread 105 can vary from about 0.1 mm to about 200 mm; 0.2 mm to about 150 mm; 0.3 mm to about 100 mm; or about 0.1 mm to about 50 mm. The pitch between each thread 105 can also range from a low of about 0.1 mm, 0.2 mm, or 0.3 mm to a high of about 2 mm, 5 mm or 10 mm.

The threads 105 can be right-handed and/or left-handed threads. For example, to facilitate connection of the insert 100 to a plug when the insert 100 is coupled to, for example, screwed into the plug, the threads 105 can be right-handed threads and the plug threads can be left-handed threads, or vice versa.

The outer surface of the insert 100 can have a constant diameter, or its diameter can vary (not shown). For example, the outer surface can include a smaller first diameter portion or area that transitions to a larger, second diameter portion or area, forming a ledge or shoulder therebetween. The shoulder can have a first end that is substantially flat, abutting the second diameter, a second end that gradually slopes or transitions to the first diameter, and can be adapted to anchor the insert 100 into the plug. The shoulder can be formed adjacent the outer threads 105 or spaced apart therefrom, and the outer threads 105 can be above or below the shoulder.

The insert 100 can include one or more channels 110 disposed or otherwise formed on an outer surface thereof. The one or more channels 110 can be disposed on the outer surface of the insert 100 toward a lower end 125 of the insert 100. A sealing material 115, such as an elastomeric O-ring, can be disposed within the one or more channels 110 to provide a fluid seal between the insert and the plug with which the insert can be engaged. Although the outer surface or outer diameter of the lower end 125 of the configurable insert 100 is depicted as being uniform, the outer surface or diameter of the lower end 125 can be tapered.

The top of the upper end 102 of the configurable insert 100 can include an upper surface interface 120 for engaging one or more tools to locate and tighten the configurable insert 100 onto the plug. The upper surface interface 120 can be, without limitation, hexagonal, slotted, notched, cross-head, square, torx, security torx, tri-wing, torq-set, spanner head, triple square, polydrive, one-way, spline drive, double hex, Bristol, Pentalobular, or other known surface shape capable of being engaged.

Figure 2:
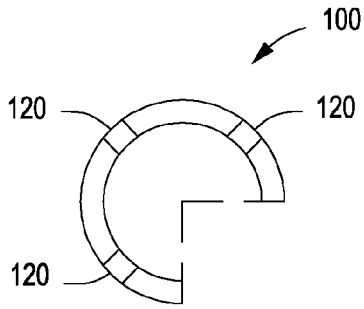
FIG. 2 depicts a top view of the illustrative insert of FIG. 1, according to one or more embodiments described.

FIG. 2 depicts a top plan view of the illustrative insert of FIG. 1, according to one or more embodiments described. As configured, the insert 100 of FIGS. 1 and 2 can be adapted to prevent fluid flow fluid flow in all directions through the insert 100.

Figure 3:
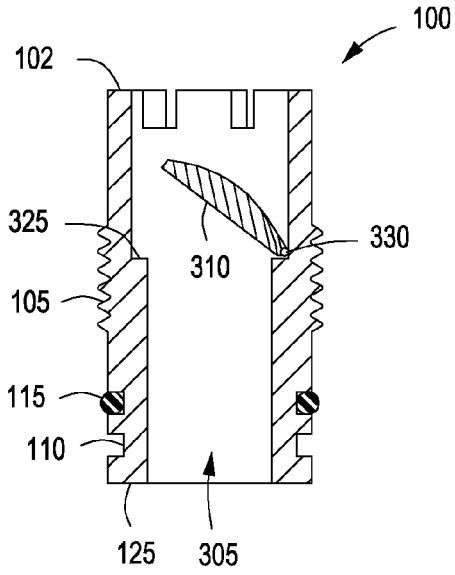
FIG. 3 depicts a partial section view of another illustrative embodiment of the insert for use with a plug for downhole use, according to one or more embodiments described.

FIG. 3 depicts a partial section view of another illustrative embodiment of the insert 100, according to one or more embodiments. A passageway or bore 305 can be completely or at least partially formed through the insert 100 to allow fluid flow in at least one direction therethrough. The bore 305 of the insert 100 can have a constant diameter, or the diameter can vary. For example, the bore can include a smaller first diameter portion or area that transitions to a larger, second diameter portion or area to form a ledge or shoulder 325 therebetween. The shoulder 325 can have a first end that is substantially flat, abutting the second diameter portion or area, and a second end that gradually slopes or transitions to the first diameter portion or area. The shoulder 325 can be adapted to receive a flapper valve member 310 that can be contained within the bore 305 using a pivot pin 330. Although not shown, the insert 100 can be further adapted to include a tension member that can urge the flapper valve member 310 into either an open or closed position, as discussed in more detail below.

Figure 4A:
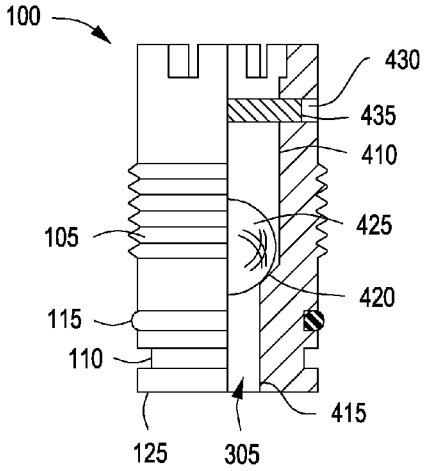
FIG. 4A depicts a partial section view of another illustrative embodiment of the insert for use with a plug for downhole use, according to one or more embodiments described.

FIG. 4A depicts a partial section view of another illustrative embodiment of the insert 100, according to one or more embodiments. The bore 305 of the insert 100 can have a constant diameter, or the diameter can vary. For example, the bore 305 can include a smaller first diameter portion or area 415 that transitions to a larger, second diameter portion or area 410 to form a ledge or shoulder 420 therebetween. The shoulder 420 can have a first end that is substantially flat, abutting the second diameter portion or area, and a second end that gradually slopes or transitions to the first diameter portion or area. The shoulder 420 can be adapted to receive a solid impediment, such as a ball 425, which can be contained within the bore 305 using a pin 435 that can be inserted into an aperture 430 of the insert 100. The pin 435 restricts movement of the ball 425 to within the length of the bore 305 between the shoulder 420 and the pin 435. In such a configuration, the ball 425 permits fluid flow from the direction of the lower end 125; however, fluid flow is restricted or prevented from the direction of the upper end 102 when the ball 425 seats at the shoulder 420, creating a fluid seal. The pin 434 prevents the ball 425 from escaping the bore 305 when fluid is moving from the direction of the lower end 125 of the insert 100.

Figure 4B:
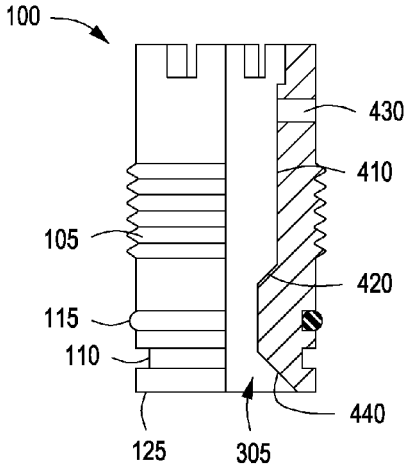
FIG. 4B depicts a partial section view of another illustrative embodiment of the insert for use with a plug for downhole use, according to one or more embodiments described.

FIG. 4B depicts a partial section view of another illustrative insert 100, according to one or more embodiments. The bore 305 of the insert 100 can have a varying diameter, for example, the bore 305 of the insert 100 can include a smaller diameter portion or area 410 that transitions to a larger diameter portion or area forming a seat or shoulder 420. The bore 305 can further include a second seat or shoulder 440 located toward the lower end 125 of the insert 100 that transitions between a smaller diameter portion or area and a larger diameter portion or area. The shoulder 440 can accept a solid impediment, e.g., a ball to prevent fluid flow upwardly through the bore 305, as the ball makes a fluid seal against the shoulder 440.

Figure 4C:
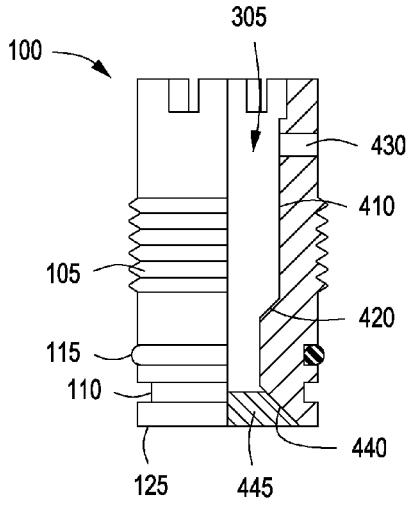
FIG. 4C depicts a partial section view of another illustrative embodiment of the insert for use with a plug for downhole use, according to one or more embodiments described.

FIG. 4C depicts a partial section view of another illustrative embodiment of the insert for use with a plug for downhole use, according to one or more embodiments. An impediment 445 can be at least partially disposed or formed within the bore 305 to block or control fluid flow in one or more directions through the bore 305 and hence, the insert 100. The impediment 445 can be any shape or size, and can be a solid component made of one or more pieces. The impediment 445 can also include one or more apertures formed therethrough to control fluid flow through the bore 305. For example, the impediment 445 can be a disc-shaped insert, washer, plug, plate, or the like, which partially or completely prevents fluid flow in one or more directions through the bore 305. The impediment 445 can be secured anywhere within the bore 305 or secured anywhere to the bore 305. As depicted in FIG. 4C, the impediment 445 can be secured to the lower end 125 of the bore 305. The impediment can be secured, either permanently or temporarily, by screwing, press-fitting, snapping, molding, plugging, adhering, riveting, or any other technique capable of temporarily or permanently locating the impediment 445 at least partially within the bore 305. In certain embodiments, the impediment 445 can be made or formed from the one or more decomposable materials described herein.

Figure 5:
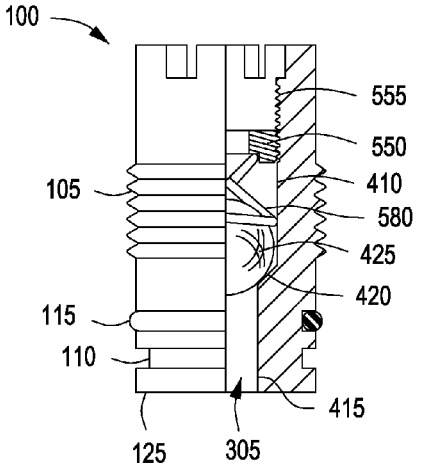
FIG. 5 depicts a partial section view of another illustrative embodiment of the insert for use with a plug for downhole use, according to one or more embodiments described.

FIG. 5 depicts a partial section view of another illustrative embodiment of the insert 100, according to one or more embodiments. The insert 100 can include one or more inner threads 555 disposed on an inner surface of the bore 305 to couple the insert 100 to another insert 100, a setting tool, another downhole tool, plug, tubing string, or impediment for restricting fluid flow. The threads 555 can be located toward, near, or at an upper end 102 of the insert 100. In one or more embodiments, the inner threads can engage an impediment, such as a ball stop 550 and a ball 425 received in the bore 305, as shown. The ball stop 550 can be coupled in the bore 305 via the threads 555, such that the ball stop 550 can be easily inserted in the field, for example. Further, the ball stop 550 can be configured to retain the ball 425 in the bore 305 between the ball stop 550 and the shoulder 420. The ball 425 can be shaped and sized to provide a fluid tight seal against the seat or shoulder 420, 440 to restrict fluid movement through the bore 305 in the insert 100. However, the ball 425 need not be entirely spherical, and can be provided as any size and shape suitable to seat against the seat or shoulder 420, 440.

Accordingly, the ball stop 550 and the ball 425 provide a one-way check valve. As such, fluid can generally flow from the lower end 125 of the insert 100 to and out through the upper end 102, thereof; however, the bore 305 may be sealed from fluid flowing from the upper end 102 of the insert 100 to the lower end 125. The ball stop 550 can be a plate, annular cover, a ring, a bar, a cage, a pin, or other component capable of preventing the ball 425 from moving past the ball stop 550 in the direction towards the upper end 102 of the insert 100. Further, the ball stop 550 can retain a tension member 580, such as a spring, to urge the solid impediment or ball 425 to more tightly seal against the seat or shoulder 420 of the insert 100. Although not shown, the impediment 445 described and depicted above with reference to FIG. 4C can be used in conjunction with or in lieu of the ball 425.

The insert 100 or at least the threads 105, 555 can be made of an alloy that includes brass. Suitable brass compositions include, but are not limited to, admiralty brass, Aich's alloy, alpha brass, alpha-beta brass, aluminum brass, arsenical brass, beta brass, cartridge brass, common brass, dezincification resistant brass, gilding metal, high brass, leaded brass, lead-free brass, low brass, manganese brass, Muntz metal, nickel brass, naval brass, Nordic gold, red brass, rich low brass, tonval brass, white brass, yellow brass, and/or any combinations thereof.

The insert 100 can also be formed or made from other metallic materials (such as aluminum, steel, stainless steel, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

Figure 6A:
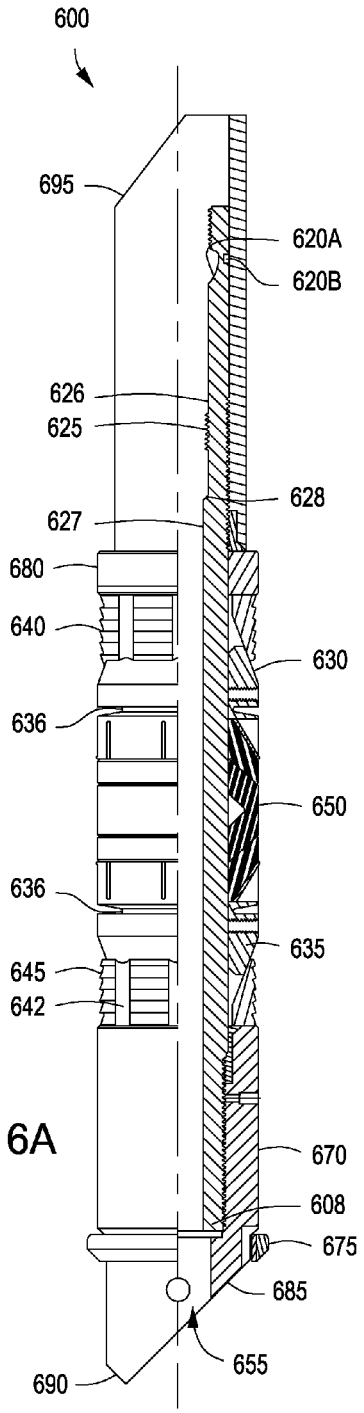
FIG. 6A depicts a partial section view of an illustrative plug for downhole use configured without an insert, according to one or more embodiments described.

FIG. 6A depicts a partial section view of an illustrative plug 600 configured without an insert 100, according to one or more embodiments. The plug 600 can include a mandrel or body 608, wherein a passageway or bore 655 can be formed at least partially through the body 608. The body 608 can be a single, monolithic component as shown, or the body 608 can be or include two or more components connected, engaged, or otherwise attached together. The body 608 serves as a centralized support member, made of one or more components or parts, for one or more outer components to be disposed thereon or thereabout.

The bore 655 can have a constant diameter throughout, or the diameter can vary, as depicted in FIGS. 6A, 6B, 6C and 6D. For example, the bore 655 can include a larger, first diameter portion or area 625 that transitions to a smaller, second diameter portion or area 627, forming a seat or shoulder 628 therebetween. The shoulder 628 can have a tapered or sloped surface connecting the two diameters portions or areas 625, 627. Although not shown, the shoulder 628 can be flat or substantially flat, providing a horizontal or substantially horizontal surface connecting the two diameters 625, 627. As will be explained in more detail below, the shoulder 628 can serve as a seat or receiving surface for plugging off the bore 655 when an insert 100, such as depicted in FIG. 1, or other solid object is coupled, for example, screwed into or otherwise placed within the bore 655.

A setting tool, tubing string, plug, or other tool can be coupled with and/or disposed within the body 608 above the shoulder 620. As further described herein, the body 608 can be sheared, fractured, or otherwise deformed, releasing the setting tool, tubing string, plug, or other tool from the plug 600.

At least one conical member (two are shown: 630, 635), at least one slip (two are shown: 640, 645), and at least one malleable element 650 can be disposed about the body 608. As used herein, the term "disposed about" means surrounding the component, e.g., the body 608, allowing for relative movement therebetween (e.g., by sliding, rotating, pivoting, or a combination thereof). A first section or second end of the conical members 630, 635 a sloped surface adapted to rest underneath a complementary sloped inner surface of the slips 640, 645. As explained in more detail below, the slips 640, 645 travel about the surface of the adjacent conical members 630, 635, thereby expanding radially outward from the body 608 to engage an inner surface of a surrounding tubular or borehole. A second section or second end of the conical members 630, 635 can include two or more tapered petals or wedges adapted to rest about an adjacent malleable element 650. One or more circumferential voids 636 can be disposed within or between the first and second sections of the conical members 630, 635 to facilitate expansion of the wedges about the malleable element 250. The wedges are adapted to hinge or pivot radially outward and/or hinge or pivot circumferentially. The groove or void 636 can facilitate such movement. The wedges pivot, rotate, or otherwise extend radially outward, and can contact an inner diameter of the surrounding tubular or borehole. Additional details of the conical members 630, 635 are described in U.S. Pat. No. 7,762,323.

The inner surface of each slip 640, 645 can conform to the first end of the adjacent conical member 630, 635. An outer surface of the slips 640, 645 can include at least one outwardly-extending serration or edged tooth to engage an inner surface of a surrounding tubular, as the slips 640, 645 move radially outward from the body 608 due to the axial movement across the adjacent conical members 630, 635.

The slips 640, 645 can be designed to fracture with radial stress. The slips 640, 645 can include at least one recessed groove 642 milled or otherwise formed therein to fracture under stress allowing the slips 640, 645 to expand outward and engage an inner surface of the surrounding tubular or borehole. For example, the slips 640, 645 can include two or more, for example, four, sloped segments separated by equally-spaced recessed grooves 642 to contact the surrounding tubular or borehole.

The malleable element 650 can be disposed between the conical members 630, 635. A three element 650 system is depicted in FIGS. 6A, 6B, 6C, 6D, 7 and 8; but any number of elements 650 can be used. The malleable element 650 can be constructed of any one or more malleable materials capable of expanding and sealing an annulus within the wellbore. The malleable element 650 is preferably constructed of one or more synthetic materials capable of withstanding high temperatures and pressures, including temperatures up to 450° F., and pressure differentials up to 15,000 psi. Illustrative materials include elastomers, rubbers, TEFLON®, blends and combinations thereof.

The malleable element(s) 650 can have any number of configurations to effectively seal the annulus defined between the body 608 and the wellbore. For example, the malleable element(s) 650 can include one or more grooves, ridges, indentations, or protrusions designed to allow the malleable element(s) 650 to conform to variations in the shape of the interior of the surrounding tubular or borehole.

At least one component, ring or other annular member 680 for receiving an axial load from a setting tool can be disposed about the body 608 adjacent a first end of the slip 640. The annular member 680 for receiving the axial load can have first and second ends that are substantially flat. The first end can serve as a shoulder adapted to abut a setting tool (not shown). The second end can abut the slip 640 and transmit axial forces therethrough.

Each end of the plug 600 can be the same or different. Each end of the plug 600 can include one or more anti-rotation features 670, disposed thereon. Each anti-rotation feature 670 can be screwed onto, formed thereon, or otherwise connected to or positioned about the mandrel 608 so that there is no relative motion between the anti-rotation feature 670 and the mandrel 608. Alternatively, each anti-rotation feature 670 can be screwed onto or otherwise connected to or positioned about a shoe, nose, cap, or other separate component, which can be made of composite, that is screwed onto threads, or otherwise connected to or positioned about the mandrel 608 so that there is no relative motion between the anti-rotation feature 670 and the mandrel 608. The anti-rotation feature 670 can have various shapes and forms. For example, the anti-rotation feature 670 can be or can resemble a mule shoe shape (not shown), half-mule shoe shape (illustrated in FIG. 9), flat protrusions or flats (illustrated in FIGS. 11 and 12), clutches (illustrated in FIG. 10), or otherwise angled surfaces 685, 690, 695 (illustrated in FIGS. 6A, 6B, 6C, 6D, 7, 8 and 9).

As explained in more detail below, the anti-rotation features 670 are intended to engage, connect, or otherwise contact an adjacent plug, whether above or below the adjacent plug, to prevent or otherwise retard rotation therebetween, facilitating faster drill-out or mill times. For example, the angled surfaces 685, 690 at the bottom of the first plug 600 can engage the sloped surface 695 of a second plug 600 in series, so that relative rotation therebetween is prevented or greatly reduced.

A pump down collar 675 can be located about a lower end of the plug 600 to facilitate delivery of the plug 600 into the wellbore. The pump down collar 675 can be a rubber O-ring or similar sealing member to create an impediment in the wellbore during installation, so that a push surface or resistance can be created.

Figure 6B:
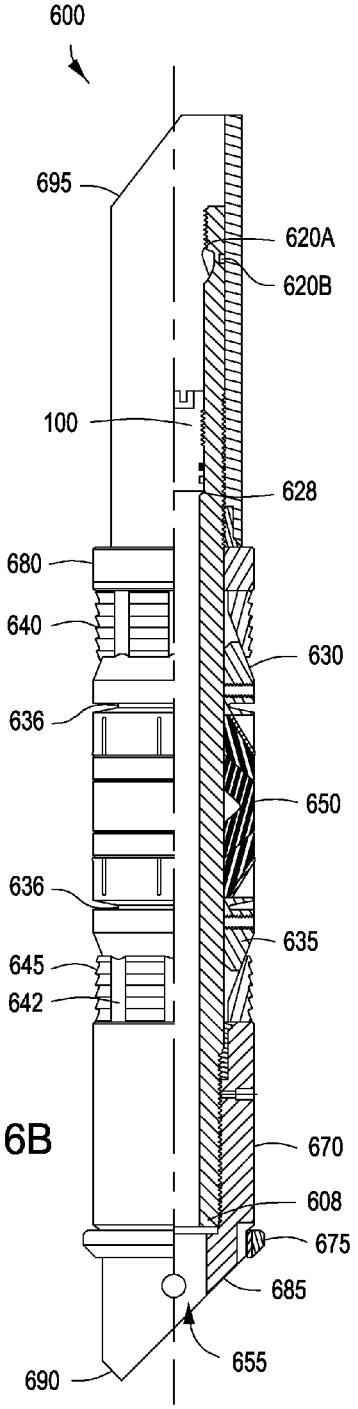
FIG. 6B depicts a partial section view of another illustrative embodiment of the plug for downhole use configured with the insert, according to one or more embodiments described.

FIG. 6B depicts a partial section view of another illustrative plug 600 configured with the insert 100, for regulating flow through the bore 655, according to one or more embodiments. The insert 100 can be coupled, for example, screwed in via threads 625 or otherwise disposed within the plug 600. A setting tool, tubing string, plug, or other tool can be threaded or otherwise disposed within the plug 600 above the shoulder 620 of the insert 100. As further described herein, the mandrel or body 608 can be sheared, fractured, or otherwise deformed, releasing the setting tool, tubing string, plug, or other tool from the plug 600. After the setting tool is removed from the plug 600, the insert 100 may remain engaged with the tool.

The insert 100 can be adapted to receive or have an impediment formed thereon restricting or preventing fluid flow in at least one direction. The impediment can include any solid flow control component known or yet to be discovered in the art, such as a ball 425 (depicted in FIGS. 4A, 4B and 5) or a flapper assembly. The flapper assembly can include a flapper member 310 (depicted in FIG. 3) connected to the insert 100 using one or more pivot pins 330. The flapper member 310 can be flat or substantially flat. Alternatively, the flapper member 310 can have an arcuate shape, with a convex upper surface and a concave lower surface. A spring or other tension member (not shown) can be disposed about the one or more pivot pins 330 to urge the flapper member 310 from a run-in ("first" or "open") position wherein the flapper member 310 does not obstruct the bore 655 through the plug 600, to an operating ("second" or "closed") position (not shown), where the flapper member 310 assumes a position proximate to the shoulder or valve seat 325, transverse to the bore 655 of the plug 600. At least a portion of the spring can be disposed upon or across the upper surface of the flapper member 310 providing greater contact between the spring and the flapper member 310, offering greater leverage for the spring to displace the flapper member 310 from the run-in position to the operating position. In the run-in position, bi-directional, e.g., upward and downward or side to side, fluid communication through the plug 600 can occur. In the operating position, unidirectional, e.g., upward as shown, fluid communication through the plug 600 can occur.

As used herein the term "arcuate" refers to any body, member, or thing having a cross-section resembling an arc. For example, a flat, elliptical member with both ends along the major axis turned downwards by a generally equivalent amount can form an arcuate member. The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses. Additional details of a suitable flapper assembly can be found in U.S. Pat. No. 7,708,066, which is incorporated by reference herein in its entirety.

Figure 6C:
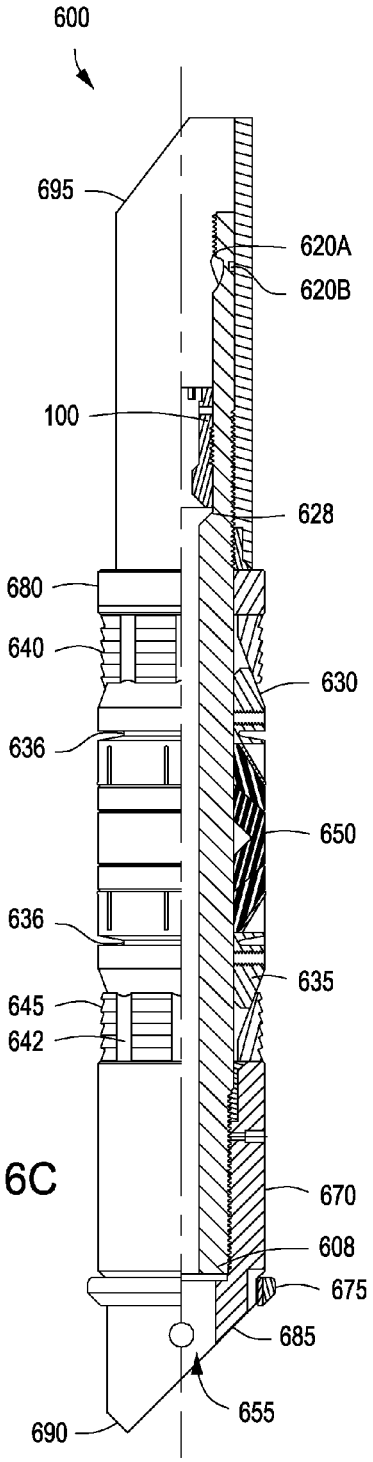
FIG. 6C depicts a partial section view of another illustrative plug for downhole use configured with the insert, according to one or more embodiments described.
Figure 6D:
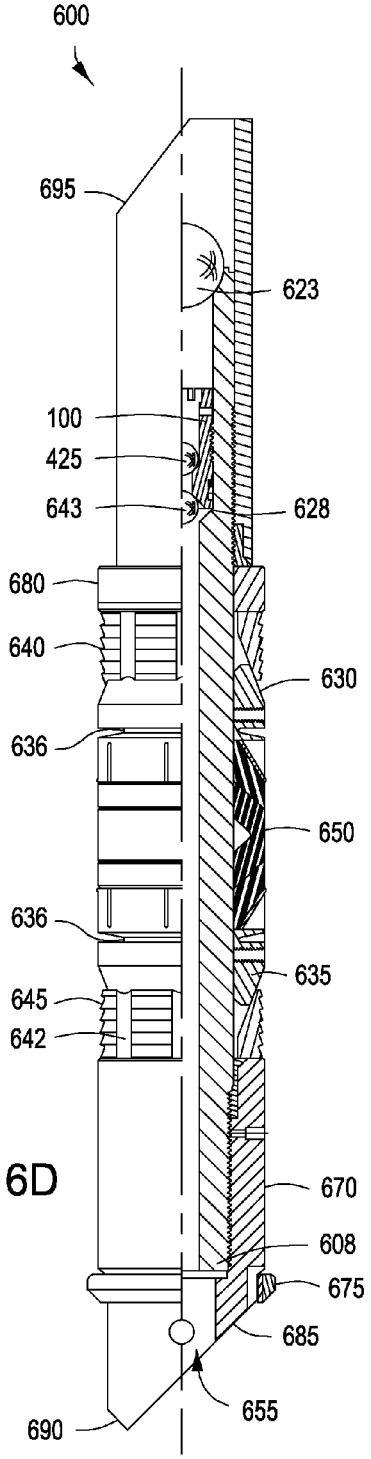
FIG. 6D depicts a partial section view of another illustrative plug for downhole use configured with the insert after a setter tool has been removed, according to one or more embodiments described.

FIGS. 6C and 6D depict partial section views of illustrative plugs 600 configured with the insert 100, for regulating flow through the bore 655, according to one or more embodiments. Prior to installing insert 100 into the wellbore, a ball 643 can be inserted into the bore 655 of the plug 600, as shown in FIG. 6D. A retaining pin or a washer can be installed into the plug 600 prior to the ball 643 to prevent the ball 643 from escaping the bore 655. According, the insert 100 can be installed in the plug 600 prior to installing the plug 600 into the wellbore. In this embodiment, shown in FIG. 6D, the ball 643 can prevent fluid flow from the lower end of the bore 655 toward the upper end of the bore 655, forming a fluid tight seal against seat 440 of the insert 100 in the plug 600 (shown in FIG. 4B). Additionally, the drop ball 425 can be used prior to or after installation of the plug 600 into the wellbore to regulate fluid flow in the direction from the upper end of the plug 100 through the bore 655 toward the lower end of the plug 600.

The plug 600 can be installed in a vertical, horizontal, or deviated wellbore using any suitable setting tool adapted to engage the plug 600. One example of such a suitable setting tool or assembly includes a gas operated outer cylinder powered by combustion products and an adapter rod. The outer cylinder of the setting tool abuts an outer, upper end of the plug 600, such as against the annular member 680. The outer cylinder can also abut directly against the upper slip 640, for example, in embodiments of the plug 600 where the annular member 680 is omitted, or where the outer cylinder fits over or otherwise avoids bearing on the annular member 680. The adapter rod is threadably connected to the mandrel 608 and/or the insert 100. Suitable setting assemblies that are commercially-available include the Owen Oil Tools wireline pressure setting assembly or a Model 10, 20 E-4, or E-5 Setting Tool available from Baker Oil Tools, for example.

Figure 7:
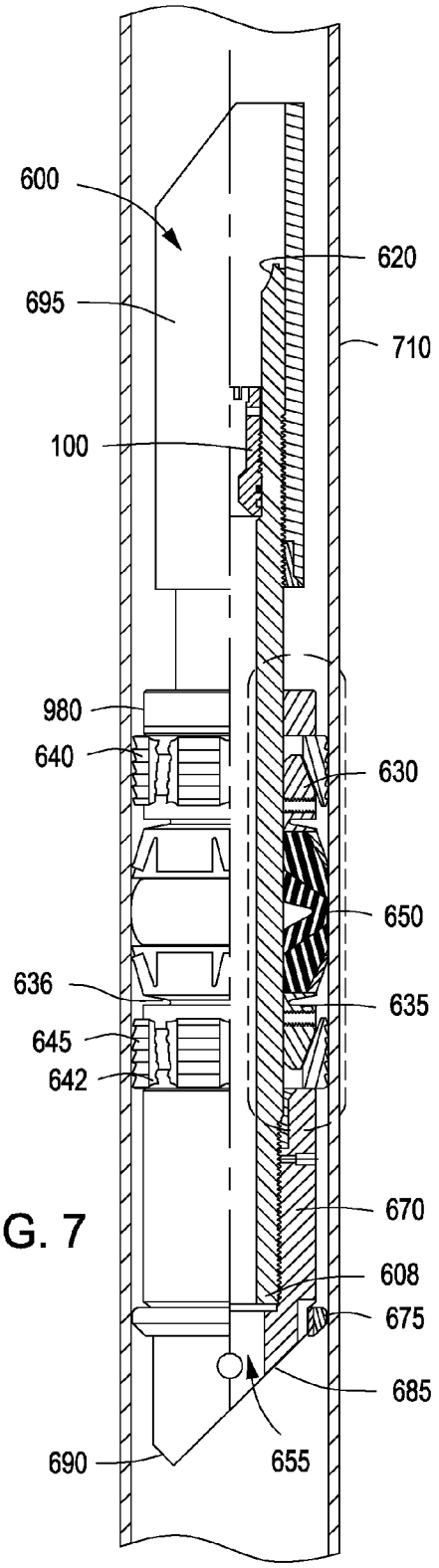
FIG. 7 depicts a partial section view of the plug of FIG. 6B located in an expanded or actuated position within the casing, according to one or more embodiments described.

During the setting process, the outer cylinder (not shown) of the setting tool exerts an axial force against the outer, upper end of the plug 600 in a downward direction that is matched by the adapter rod of the setting tool exerting an equal and opposite force from the lower end of the plug 600 in an upward direction. For example, in the embodiments illustrated in FIGS. 6A, 6B, 6C, 6D and 7, the outer cylinder of the setting assembly exerts an axial force on the annular member 680, which translates the force to the slips 640, 645 and the malleable elements 650 that are disposed about the mandrel 608 of the plug 600. The translated force fractures the recessed groove(s) 642 of the slips 640, 645, allowing the slips 640, 645 to expand outward and engage the inner surface of the casing or wellbore 710, while at the same time compresses the malleable elements 650 to create a seal between the plug 600 and the inner surface of the casing or wellbore 710, as shown in FIG. 7. FIG. 7 depicts an illustrative partial section view of the expanded plug 600, according to one or more embodiments described.

After actuation or installation of the plug 600, the setting tool can be released from the mandrel 608 of the plug 600, or the insert 100 that is screwed into the plug 600 by continuing to apply the opposing, axial forces on the mandrel 608 via the adapter rod and the outer cylinder. The opposing, axial forces applied by the outer cylinder and the adapter rod result in a compressive load on the mandrel 608, which is borne as internal stress once the plug 600 is actuated and secured within the casing or wellbore 710. The force or stress is focused on the shear groove 620A, 620B, which will eventually shear, break, or otherwise deform at a predetermined force, releasing the adapter rod from the mandrel 608. The predetermined axial force sufficient to deform the shear groove 620A, 620B to release the setting tool is less than the axial force sufficient to break the plug 600.

Figure 8:
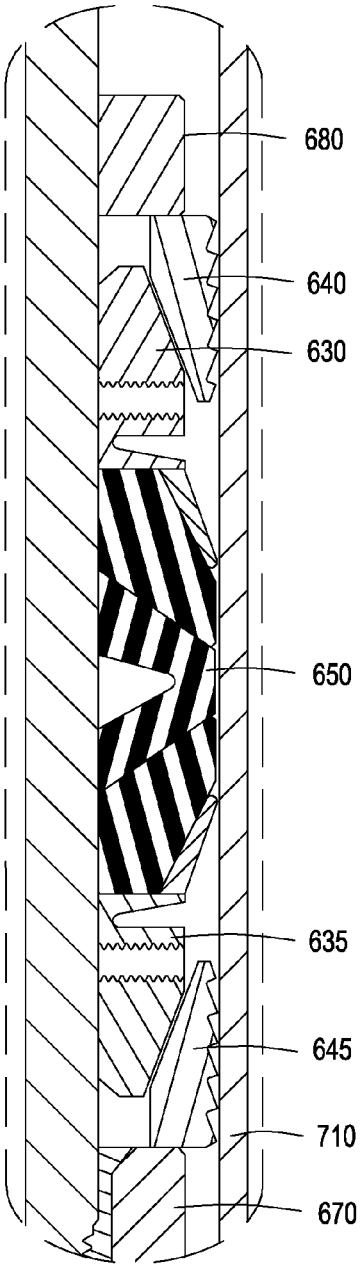
FIG. 8 depicts a partial section view of the expanded plug depicted in FIG. 7, according to one or more embodiments described.

Once actuated and released from the setting tool, the plug 600 is left in the wellbore to serve its purpose, as depicted in FIGS. 7 and 8. FIG. 8 depicts an illustrative partial section view of the expanded plug 600 depicted in FIG. 7, according to one or more embodiments described. For example, the ball 425 can be dropped in the wellbore to constrain, restrict, and/or prevent fluid communication in a first direction through the body 608. The dropped ball 425 can rest on the transition or ball seat 420 to form an essentially fluid-tight seal therebetween, preventing downward fluid flow through the plug 600 ("the first direction") while allowing upward fluid flow through the plug 600 ("the second direction"). In addition or alternatively, a second drop ball 623 can be dropped in the wellbore to constrain, restrict, and/or prevent fluid communication in a first direction through the body 608. The ball 623 can rest on the transition or ball seat 620A to form an essentially fluid-tight seal therebetween, preventing downward fluid flow through the plug 600 while allowing upward fluid flow through the plug 600. Alternatively, the flapper member 310 can rotate toward the closed position to constrain, restrict, and/or prevent downward fluid flow through the plug 600 ("the first direction") while allowing upward fluid flow through the plug 600 ("the second direction").

As discussed and described in more detail below, any one or more components of the plug 600, including any of the body, rings, slips, conical members or cones, malleable or sealing elements, shoes, anti-rotation features, balls 425, 623, 643, impediments 445, flapper member 310, inserts, etc., can be fabricated from one or more decomposable materials. Suitable decomposable materials will at least partially decompose, degrade, degenerate, melt, combust, soften, decay, break up, break down, dissolve, disintegrate, break, dissociate, reduce into smaller pieces or components, or otherwise fall apart when exposed to one or more predetermined triggers. The predetermined trigger can be unintentional or intentional. The predetermined trigger can be or include certain wellbore conditions or environments, such as predetermined temperature, pressure, pH, and/or any combinations thereof. Said another way, the predetermined trigger can be or include any one or more of the following, whether intentional or unintentional: change in temperature; change in pressure; change in acidity or basicity; change in chemical composition of the decomposable material, physical interaction with the decomposable material, or any combination thereof.

As such, fluid communication through the plug 600 can be prevented for a predetermined period of time, e.g., until and/or if the decomposable material(s) falls apart, e.g., degrades sufficiently, allowing fluid flow therethrough. The predetermined period of time can be sufficient to pressure test one or more hydrocarbon-bearing zones within the wellbore. In one or more embodiments, the predetermined period of time can be sufficient to workover the associated well. The predetermined period of time can range from minutes to days. For example, the decomposable or degradable rate of the material can range from about 5 minutes, 40 minutes, or 4 hours to about 12 hours, 24 hours or 48 hours. In another example, the decomposable or degradable rate of the material can be from a low of about 1 second, about 1 minute, about 5 minutes, about 30 minutes, about 1 hour, about 2 hours, about 4 hours, about 8 hours, or about 12 hours to a high of about 1 day, about 2 days, about 3 days, about 4 days, or about 5 days. In at least one embodiment, the decomposable or degradable rate of the material can be sufficient that fluid may flow through the plug 600 in less than 5 days, less than 4 days, less than 3 days, less than 2.5 days, less than 2 days, less than 1.75 days, less than 1.5 days, less than 1.25 days, less than 1 day, less than 0.75 days, less than 0.5 days, or less than 0.25 days. Extended periods of time are also contemplated.

The pressures at which the ball 425, 623, 643, the impediment 445, the flapper member 310, and/or any other component of the plug 600 decompose can range from less than atmospheric pressure to about 15,000 psig, about atmospheric pressure to about 15,000 psig, or about 100 psig to about 15,000 psig. For example, the pressure can range from a low of about 100 psig, 1,000 psig, or 5,000 psig to a high about 7,500 psig, 10,000 psig, or about 15,000 psig. The temperatures at which the ball 425, 623, 643, the impediment 445, or the flapper member 310, or any other component of the plug 600 made from or otherwise including the decomposable material can decompose range from about 0° C. to about 800° F., about 100° F. to about 750° F. For example, the temperature can range from a low of about 20° F., 100° F., 150° F., or 200° F. to a high of about 350° F., 500° F., or 750° F. In another example, the temperature at which the decomposable material can decompose can be at least 100° F., at least 125° F., at least 150° F., at least 175° F., at least 200° F., at least 250° F., at least 275° F., at least 300° F., at least 325° F., at least 350° F., at least 375° F., or at least 400° F. and less than 750° F., less than 725° F., less than 700° F., less than 675° F., less than 650° F., less than 625° F., less than 600° F., less than 575° F., or less than 550° F.

The decomposable material can be soluble in any material, such as soluble in water, polar solvents, non-polar solvents, acids, bases, mixtures thereof, or any combination thereof. The solvents can be time-dependent solvents. A time-dependent solvent can be selected based on its rate of degradation. For example, suitable solvents can include one or more solvents capable of degrading the soluble components in about 30 minutes, 1 hour, or 4 hours, to about 12 hours, 24 hours, or 48 hours. Extended periods of time are also contemplated.

The pHs at which the ball 425, 623, 643, the impediment 445, or the flapper member 310, or any other component of the plug 600 can decompose can range from about 1 to about 14. For example, the pH can range from a low of about 1, 3, or 5 to a high about 9, 11, or about 14. If the predetermined trigger is or includes a pH, the decomposable material can be exposed to a fluid having a pH of from a low of about 1, about 2, about 3, about 4, about 5, or about 6 to a high about 8, about 9, about 10, about 11, about 12, about 13, or about 14. The pH of the environment around the plug 600 or at least the component thereof containing the decomposable material can be modified, adjusted, controlled, or otherwise changed by introducing one or more acids, one or more bases, or one or more neutral compounds thereto.

Suitable base compounds can include, but are not limited to, hydroxides, carbonates, ammonia, amines, amides, or any mixture thereof. Illustrative hydroxides can include, but are not limited to, sodium hydroxide, potassium hydroxide, ammonium hydroxide (e.g., aqueous ammonia), lithium hydroxide, cesium hydroxide, or any mixture thereof. Illustrative carbonates can include, but are not limited to, sodium carbonate, sodium bicarbonate, potassium carbonate, ammonium carbonate, or any mixture thereof. Illustrative amines can include, but are not limited to, trimethylamine, triethylamine, triethanolamine, diisopropylethylamine (Hunig's base), pyridine, 4-dimethylaminopyridine (DMAP), 1,4-diazabicyclo[2.2.2]octane (DAB CO), or any mixture thereof.

Suitable acidic compounds can include, but are not limited to, one or more mineral acids, one or more organic acids, one or more acid salts, or any mixture thereof. Illustrative mineral acids can include, but are not limited to, hydrochloric acid, nitric acid, phosphoric acid, sulfuric acid, or any mixture thereof. Illustrative organic acids can include, but are not limited to, acetic acid, formic acid, citric acid, oxalic acid, uric acid, lactic acid, or any mixture thereof. Illustrative acid salts can include, but are not limited to, ammonium sulfate, sodium bicarbonate, sodium hydrosulfide, sodium bisulfate, sodium metabisulfite, or any mixture thereof.

One suitable neutral compound can be or include, but is not limited to, water. In at least one specific embodiment, the predetermined trigger can include contacting the decomposable material with water. The water can be in the form of liquid water, water vapor, e.g., steam, or any fluid that includes liquid water and/or water vapor. Examples of fluids that can include liquid water and/or water vapor include liquid water and/or water vapor mixed with one or more acids and/or one or more bases.

It should be noted that the one or more bases and/or acids and/or neutral compounds can also chemically react with and/or physically interact with the decomposable material. As such, the base and/or acid and/or neutral compound, if present, can be used to adjust the pH and/or chemically react with and/or physically react with the decomposable material to cause, accelerate, or otherwise promote the at least partial melting, combustion, softening, decay, break up, break down, dissolving, disintegration, decomposition, breaking, dissociation, or otherwise reduce into smaller pieces or components. Some examples of reactive compounds, whether chemically reactive or physically reactive, can include, but are not limit to, water, hydrocarbons, e.g., aliphatic and/or aromatic, alcohols, ketones, alkyl halides, amines, esters, ethers, acyl halides, imides, acid anhydrides, any combination thereof or any mixture thereof.

To remove the plug 600 from the wellbore, the plug 600 can be drilled-out, milled, or otherwise compromised. As it is common to have two or more plugs 600 located in a single wellbore to isolate multiple zones therein, during removal of one or more plugs 600 from the wellbore some remaining portion of a first, upper plug 600 can release from the wall of the wellbore at some point during the drill-out. Thus, when the remaining portion of the first, upper plug 600 falls and engages an upper end of a second, lower plug 600, the anti-rotation features 670 of the remaining portions of the plugs 600, will engage and prevent, or at least substantially reduce, relative rotation therebetween.

Figure 10:
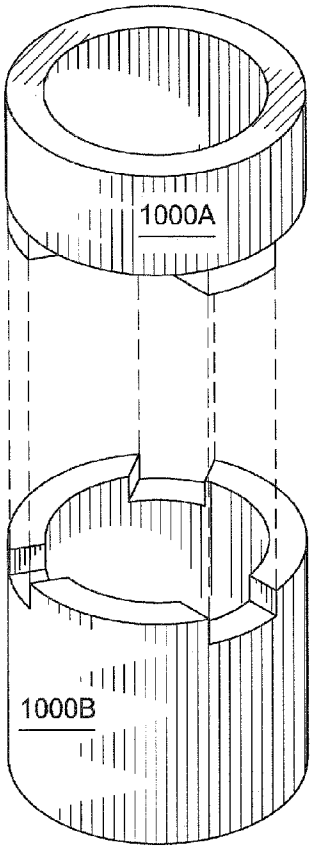
FIG. 10 depicts an illustrative, dog clutch anti-rotation feature, allowing a first plug and a second plug to interact and/or engage in series, according to one or more embodiments described.
Figure 9:
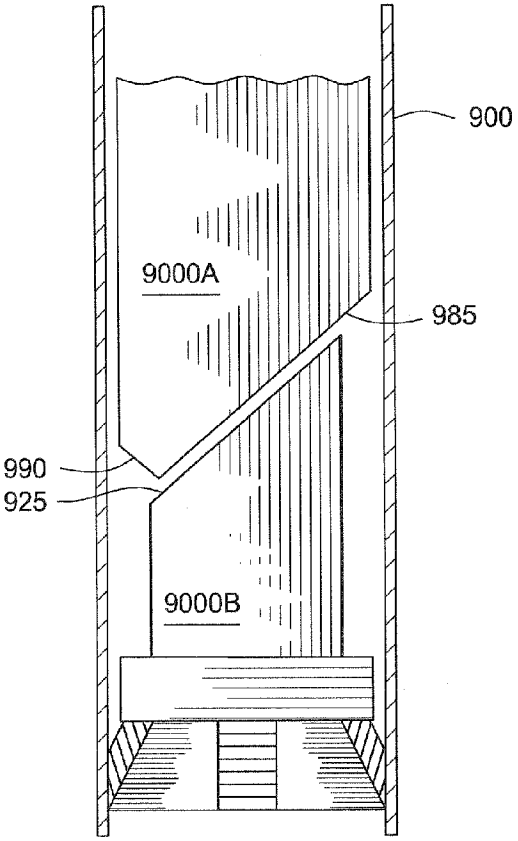
FIG. 9 depicts an illustrative, complementary set of angled surfaces that function as anti-rotation features adapted to interact and/or engage between a first plug and a second plug in series, according to one or more embodiments described.
Figure 12:
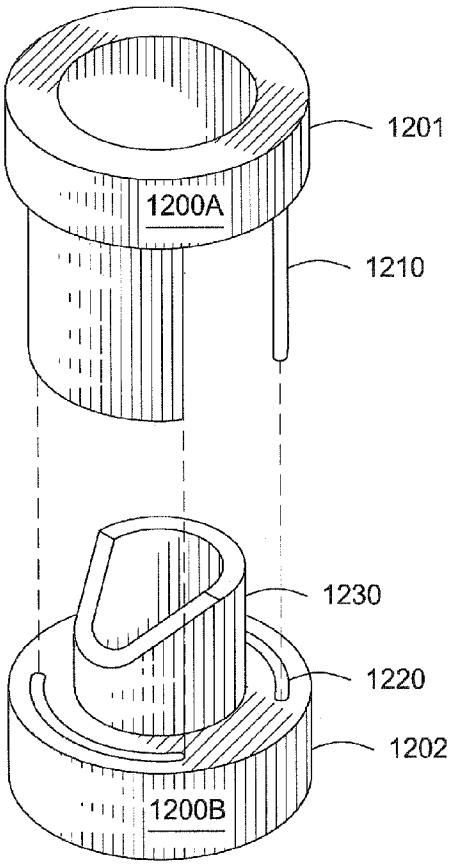
FIG. 12 depicts another illustrative, complementary set of flats and slots that serve as anti-rotation features to interact and/or engage between a first plug and a second plug in series, according to one or more embodiments described.
Figure 11:
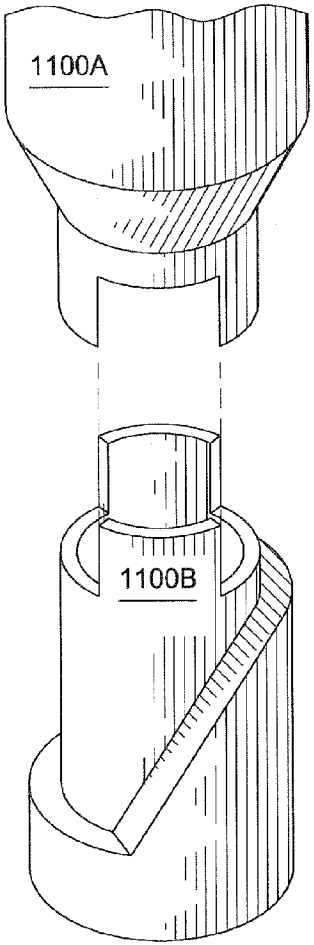
FIG. 11 depicts an illustrative, complementary set of flats and slots that serve as anti-rotation features to interact and/or engage between a first plug and a second plug in series, according to one or more embodiments described.

FIGS. 9-12 depict schematic views of illustrative anti-rotation features 670 that can be used with the plugs 600 to prevent or reduce rotation during drill-out. These features are not intended to be exhaustive, but merely illustrative, as there are many other configurations that are equally effective to accomplish the same results. Each end of the plug 600 can be the same or different. For example, FIG. 9 depicts angled surfaces or half-mule anti-rotation feature; FIG. 10 depicts dog clutch type anti-rotation features; and FIGS. 11 and 12 depict two types of flats and slotted noses or anti-rotation features.

Referring to FIG. 9, a lower end of the upper plug 900A and an upper end of the lower plug 900B are shown within the casing 710 where the angled surfaces 985, 990 interact with, interface with, interconnect, interlock, link with, join, jam with or within, wedge between, or otherwise communicate with a complementary angled surface 925 and/or at least a surface of the wellbore or casing 900. The interaction between the lower end of the upper plug 900A and the upper end of the lower plug 900B and/or the casing 900 can counteract a torque placed on the lower end of the upper plug 900A, and prevent or greatly reduce rotation therebetween. For example, the lower end of the upper plug 900A can be prevented from rotating within the wellbore or casing 900 by the interaction with upper end of the lower plug 900B, which is held securely within the casing 900.

Referring to FIG. 10, dog clutch surfaces of the upper plug 1000A can interact with, interface with, interconnect, interlock, link with, join, jam with or within, wedge between, or otherwise communicate with a complementary dog clutch surface of the lower plug 1000B and/or at least a surface of the wellbore or casing 900. The interaction between the lower end of the upper plug 1000A and the upper end of the lower plug 1000B and/or the casing 900 can counteract a torque placed on the lower end of the upper plug 1000A, and prevent or greatly reduce rotation therebetween. For example, the lower end of the upper plug 1000A can be prevented from rotating within the wellbore or casing 900 by the interaction with upper end of the lower plug 1000B, which is held securely within the casing 900.

Referring to FIG. 11, the flats and slotted surfaces of the upper plug 1100A can interact with, interface with, interconnect, interlock, link with, join, jam with or within, wedge between, or otherwise communicate with a complementary flats and slotted surfaces of the lower plug 1100B and/or at least a surface of the wellbore or casing 900. The interaction between the lower end of the upper plug 1100A and the upper end of the lower plug 1100B and/or the casing 900 can counteract a torque placed on the lower end of the upper plug 1100A, and prevent or greatly reduce rotation therebetween. For example, the lower end of the upper plug 1100A can be prevented from rotating within the wellbore or casing 900 by the interaction with upper end of the lower plug 1100B, which is held securely within the casing 900. The protruding perpendicular surfaces of the lower end of the upper plug 1100A can mate in only one resulting configuration with the complementary perpendicular voids of the upper end of the lower plug 1100B. When the lower end of the upper plug 1100A and the upper end of the lower plug 1100B are mated, any further rotational force applied to the lower end of the upper plug 1100A will be resisted by the engagement of the lower plug 1100B with the wellbore or casing 900, translated through the mated surfaces of the anti-rotation feature 670, allowing the lower end of the upper plug 1100A to be more easily drilled-out of the wellbore.

One alternative configuration of flats and slotted surfaces is depicted in FIG. 12. The protruding cylindrical or semi-cylindrical surfaces 1210 perpendicular to the base 1201 of the lower end of the upper plug 1200A mate in only one resulting configuration with the complementary aperture(s) 1220 in the complementary base 1202 of the upper end of the lower plug 1200B. Protruding surfaces 1210 can have any geometry perpendicular to the base 1201, as long as the complementary aperture(s) 1220 match the geometry of the protruding surfaces 1201 so that the surfaces 1201 can be threaded into the aperture(s) 1220 with sufficient material remaining in the complementary base 1202 to resist rotational force that can be applied to the lower end of the upper plug 1200A, and thus translated to the complementary base 1202 by means of the protruding surfaces 1201 being inserted into the aperture(s) 1220 of the complementary base 1202. The anti-rotation feature 670 may have one or more protrusions or apertures 1230, as depicted in FIG. 12, to guide, interact with, interface with, interconnect, interlock, link with, join, jam with or within, wedge between, or otherwise communicate or transmit force between the lower end of the upper plug 1200A and the upper end of the lower plug 1200B. The protrusion or aperture 1230 can be of any geometry practical to further the purpose of transmitting force through the anti-rotation feature 670.

The orientation of the components or anti-rotation features 670 depicted in all figures is arbitrary. Because plugs 600 can be installed in horizontal, vertical, and deviated wellbores, either end of the plug 600 can have any anti-rotation feature 670 geometry, wherein a single plug 600 can have one end of the first geometry and one end of the second geometry. For example, the anti-rotation feature 670 depicted in FIG. 9 can include an alternative embodiment where the lower end of the upper plug 900A is manufactured with geometry resembling 900B and vice versa. Each end of each plug 600 can be or include angled surfaces, half-mule, mule shape, dog clutch, flat and slot, cleated, slotted, spiked, and/or other inter-digitating designs. In the alternative to a plug 600 with complementary anti-rotation feature 670 geometry on each end of the plug 600, a single plug 600 can include two ends of differently-shaped anti-rotation features, such as the upper end may include a half-mule anti-rotation feature 670, and the lower end of the same plug 600 may include a dog clutch type anti-rotation feature 670. Further, two plugs 600 in series may each comprise only one type anti-rotation feature 670 each, however the interface between the two plugs 600 may result in two different anti-rotation feature 670 geometries that can interface with, interconnect, interlock, link with, join, jam with or within, wedge between, or otherwise communicate or transmit force between the lower end of the upper plug 600 with the first geometry and the upper end of the lower plug 600 with the second geometry.

Any of the aforementioned components of the plug 600, including the body, rings, cones, elements, shoe, etc., can be formed or made from any one or more metallic materials (such as aluminum, steel, stainless steel, brass, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

However, as many components as possible are made from one or more composite materials. Suitable composite materials can be or include polymeric composite materials that are reinforced by one or more fibers such as glass, carbon, or aramid, for example. The individual fibers can be layered parallel to each other, and wound layer upon layer. Each individual layer can be wound at an angle of from about 20 degrees to about 160 degrees with respect to a common longitudinal axis, to provide additional strength and stiffness to the composite material in high temperature and/or pressure downhole conditions. The particular winding phase can depend, at least in part, on the required strength and/or rigidity of the overall composite material.

The polymeric component of the composite can be an epoxy blend. The polymer component can also be or include polyurethanes and/or phenolics, for example. In one aspect, the polymeric composite can be a blend of two or more epoxy resins. For example, the polymeric composite can be a blend of a first epoxy resin of bisphenol A and epichlorohydrin and a second cycoaliphatic epoxy resin. Preferably, the cycloaphatic epoxy resin is ARALDITE® liquid epoxy resin, commercially available from Ciga-Geigy Corporation of Brewster, N.Y. A 50:50 blend by weight of the two resins has been found to provide the suitable stability and strength for use in high temperature and/or pressure applications. The 50:50 epoxy blend can also provide suitable resistance in both high and low pH environments.

The fibers can be wet wound. A prepreg roving can also be used to form a matrix. The fibers can also be wound with and/or around, spun with and/or around, molded with and/or around, or hand laid with and/or around a metallic material or two or more metallic materials to create an epoxy impregnated metal or a metal impregnated epoxy.

A post cure process can be used to achieve greater strength of the material. A suitable post cure process can be a two stage cure having a gel period and a cross-linking period using an anhydride hardener, as is commonly know in the art. Heat can be added during the curing process to provide the appropriate reaction energy that drives the cross-linking of the matrix to completion. The composite may also be exposed to ultraviolet light or a high-intensity electron beam to provide the reaction energy to cure the composite material.

Suitable decomposable materials can be or include, but are not limited to, one or more halogenated elastomers, polyesters, polyamides, polyurethanes, polyimides, polyethers, polyphenylene sulfides, polysulfones, polyphenylene oxides, polydicyclopentadienes, polyacrylonitriles, polyetherimides, polyolefins, polyethylenechlorinates, polyaryletherketones, styrenes, vulcanized plastics, polyvinyls, polyacrylics, polymethacrylics, any combination thereof, or any mixture thereof. Specific examples of decomposable materials can include, but are not limited to, polytetrafluoroethylene, polyvinyl fluoride, polyvinylidine fluoride, perfluoroalkoxy, fluorinated ethylene propylene, polyglycolic acid, polylactic acid, polyhydroxybutyrate, polyethyelene terephthalate, polybutylene, polmethylmethacrylate, polycarbonate, polypropylene carbonate, cellulose acetate butyrate, polyacetal, nylon 6, nylon 66, nylon 6-12, polyphthalamide, polyparaphenylene terephthalamide, polyurethanes, polystyrene, vulcanized plastic, styrene-isoprene-styrene, polyphenylene sulfide, polystyrene-co-acrylonitrile, polysulfone, polyphenylsulfone, polyetheretherketone, polydioxanone, polyaryletherketone, polyacrylonitrile, polyimide, polyethylene, polypropylene, any combination thereof or any mixture thereof.

Illustrative polyesters can be or include aliphatic polyesters, semi-aromatic polyesters, aromatic polyesters, any combination thereof, or any mixture thereof. Illustrative aliphatic polyesters can include, but are not limited to, polyglycolic acid, polylactic acid, polycaprolactone, polyethylene adipate, polyhydroxyalkanoate, polyhydroxy butyrate, poly(3-hydroxybutyrate-co-3-hydroxyvalerate), any combination thereof, or any mixture thereof. Illustrative semi-aromatic polyesters can include, but are not limited to, polyethylene terephthalate, polybutylene terephthalate, polytrimethylene terephthalate, polyethylene naphthalate, any combination thereof, or any mixture thereof. One aromatic polyester can include vectran, which can be produced by the polycondensation of 4-hydroxybenzoic acid and 6-hydroxynaphthalene-2-carboxylic acid.

In at least one specific embodiment, the decomposable material can be or include one or more aliphatic polyesters. For example, the decomposable material can be or include homopolymers and/or copolymers of one or more glycolic acids, one or more lactic acids, one or more cyclic monomers, one or more hydroxycarboxylic acids, one or more aliphatic ester monomers, any combination thereof, or any mixture thereof. Illustrative glycolic acids can include glycolic acid and glycolide. Glycocide is a bimolecular cyclic ester of glycolic acid. Illustrative lactic acids can include lactic acid and lactide. Lactide is a bimolecular cyclic ester of lactic acid. Lactic acid is chiral and has two optical isomers, i.e., L-lactic acid and D-lactic acid, either or both of which can be used to make the aliphatic polyester. Illustrative cyclic monomers can include, but are not limited to, one or more ethylene oxalates, one or more lactones, one or more carbonates, one or more ethers, one or more ether esters, any combination thereof, or any mixture thereof. A suitable ethylene oxalate can include, but is not limited to, 1,4-dioxane-2,3-dione. Suitable lactones can include, but are not limited to, β-propiolactone, β-butyrolactone, pivalolactone, γ-butyrolactone, δ-valerolactone, β-methyl-δ-valerolactone, ϵ-caprolactone, any combination thereof, or any mixture thereof. Illustrative hydroxycarboxylic acids can include, but are not limited to, lactic acid, 3-hydroxypropanoic acid, 4-hydroxybutanoic acid, 6-hydroxycaproic acid, alkyl esters thereof, any combination thereof, or any mixture thereof. Illustrative aliphatic ester monomers can include, but are not limited to, mixtures of an aliphatic diol and an aliphatic dicarboxylic acid. For example, the aliphatic diol can be or include ethylene glycol and/or 1,4-butanediol and the aliphatic dicarboxylic acid can be or include succinic acid, adipic acid, and/or an alkyl ester thereof. If an aliphatic diol and an aliphatic dicarboxylic acid are present, the aliphatic diol and the aliphatic dicarboxylic acid can be present in a substantially equimolar ratio. For example, a molar ratio of the aliphatic diol to the aliphatic dicarboxylic acid can be from about 1:0.9 to about 0.9:1, e.g., about 1:1.

An aliphatic polyester containing a repeating unit derived from glycolic acid and/or lactic acid can be represented by the formula: [—O—CH(R)—C(O)—], where R is a hydrogen atom or a methyl group, respectively. In at least one specific embodiment, the aliphatic polyester can be or include a repeating unit derived from glycolic acid in an amount of at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, at least 95 wt %, or at least 99 wt %, based on the total weight of the aliphatic polyester. In at least one specific embodiment, the aliphatic polyester can be a homopolymer containing the repeating unit derived from glycolic acid in an amount of about 100%, based on the total weight of the aliphatic polyester. In at least one specific embodiment, the aliphatic polyester can be or include a repeating unit derived from lactic acid in an amount of at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, at least 95 wt %, or at least 99 wt %, based on the total weight of the aliphatic polyester. In at least one specific embodiment, the aliphatic polyester can be a homopolymer containing the repeating unit derived from lactic acid in an amount of about 100%, based on the total weight of the aliphatic polyester. In at least one specific embodiment, the aliphatic polyester can be or include a repeating unit derived from a reaction product of glycolic acid and lactic acid in an amount of at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, at least 95 wt %, or at least 99 wt %, based on the total weight of the aliphatic polyester. In at least one specific embodiment, the aliphatic polyester can be a copolymer containing the repeating unit derived from a reaction product of glycolic acid and lactic acid in an amount of about 100%, based on the total weight of the aliphatic polyester. As used herein, the term "copolymer" includes a polymer derived from two or more monomers. As such, the term "copolymer" includes terpolymers.

The aliphatic polyester can be synthesized by, for example, dehydration polycondensation of an α-hydroxycarboxylic acid such as glycolic acid or lactic acid. Preparation of aliphatic polyesters via dehydration polycondensation is a well known process. In addition to dehydration polycondensation, another well known process for preparing the aliphatic polyester can include ring-opening polymerization of a bimolecular cyclic ester of an α-hydroxycarboxylic acid. For example, when the bimolecular cyclic ester of glycolic acid, i.e., glycolide, undergoes ring-opening polymerization, polyglycolic acid or "PGA" is produced. In another example, when the bimolecular cyclic ester of lactic acid, i.e., lactide, is subjected to ring-opening polymerization, polylactic acid or "PLA" is produced. The cyclic ester can also be derived from other α-hydroxycarboxylic acids, which can include, but are not limited to, α-hydroxybutyric acid, α-hydroxyisobutyric acid, α-hydroxyvaleric acid, α-hydroxycaproic acid, α-hydroxyisocaproic acid, α-hydroxyheptanoic acid, α-hydroxyoctanoic acid, α-hydroxydecanoic acid, α-hydroxymyristic acid, α-hydroxystearic acid, and alkyl-substituted products thereof.

The ring-opening polymerization of the bimolecular cyclic ester of an α-hydroxycarboxylic acid can be carried out or conducted in the presence of one or more catalysts. The ring-opening polymerization can be carried out or conducted at a temperature from a low of about 90° C., about 100° C., about 110° C., about 120° C., about 130° C., or about 140° C. to a high of about 160° C., about 170° C., about 180° C., about 190° C., about 200° C., or about 210° C. For example, the ring-opening polymerization can be carried out at a temperature of about 135° C. to about 200° C., about 140° C. to about 195° C., about 150° C. to about 190° C., or about 160° C. to about 190° C.

Suitable catalysts that can be used to promote or accelerate the ring-opening polymerization of the bimolecular cyclic ester can include, but are not limited to, one or more oxides, one or more halides, one or more carboxylic acid salts, and/or one or more alkoxides of one or more metals such as tin (Sn), titanium (Ti), aluminum (Al), antimony (Sb), zirconium (Zr), zinc (Zn) and germanium (Ge). For example, the catalyst can be or include tin compounds including tin halides (e.g., tin dichloride and/or tin tetrachloride), tin organic-carboxylates (e.g., tin octanoates such as tin 2-ethylhexanoate), titanium compounds such as alkoxy-titanates, aluminum compounds such as alkoxy-aluminums, zirconium compounds such as zirconium acetylacetone, and antimony halides. The amount of the catalyst can be from a low of about 0.0001 wt %, about 0.001 wt %, about 0.01 wt %, or about 0.1 wt % to a high of about 0.15 wt %, about 0.2 wt %, about 0.25 wt %, about 0.3 wt %, about 0.4 wt %, about 0.5 wt %, about 0.7 wt %, or about 1 wt %.

The aliphatic polyester can have a weight average molecular weight (Mw) of from a low of about 500, about 600, about 700, about 800, about 900, about 1,000, about 3,000, about 5,000, about 10,000, about 15,000, about 20,000, about 25,000, about 50,000, about 100,000, about 300,000, about 600,000, or about 900,000 to a high of about 1,000,000, about 2,000,000, about 3,000,000, about 4,000,000, about 5,000,000, about 6,000,000, or about 7,000,000. In another example, the aliphatic polyester can have a weight average molecular weight of from a low of about 30,000, about 40,000, about 50,000, about 70,000, about 90,000, about 110,000, about 150,000, or about 200,000 to a high of about 700,000, about 800,000, about 900,000, about 1,000,000, about 1,200,000, about 1,300,000, or about 1,500,000. In another example, the aliphatic polyester can have a weight average molecular weight of at least 600, at least 1,000, at least 5,000, at least 10,000, at least 20,000, at least 30,000, at least 40,000, at least 50,000, at least 70,000, at least 90,000, at least 110,000, at least 150,000, at least 200,000, at least 300,000, or at least 400,000.

The weight average molecular weight (Mw) of the aliphatic polyester can be determined by a gel permeation chromatography (GPC) analyzer. More particularly, after an aliphatic polyester sample dissolves in a solution having a predetermined concentration of sodium trifluoroacetate dissolved in hexafluoroisopropanol (HFIP), the solution can be filtered through a membrane filter to prepare a sample solution. The sample solution can be injected into the gel permeation chromatography (GPC) analyzer to measure a molecular weight, and a weight average molecular weight (Mw) can be calculated out from the result measured.

The polyglycolic acid can have a crystalline melting point (Tm) of from a low of about 197° C., about 200° C., about 203° C., about 205° C., about 210° C., about 215° C., or about 220° C. to a high of about 230° C., about 235° C., about 240° C., or about 245° C. The polylactic acid can have a crystalline melting point (Tm) of from a low of about 145° C., about 150° C., about 155° C., about 160° C., or about 165° C. to a high of about 170° C., about 175° C., about 180° C., or about 185° C. The crystalline melting point can be controlled or adjusted by, for example, the weight average molecular weight (Mw), the molecular weight distribution, and/or the presence of and/or amount of one or more copolymerization components. The crystalline melting point (Tm) of the aliphatic polyester can be determined under a nitrogen atmosphere via a differential scanning calorimeter (DSC). The crystalline melting point refers to a temperature of an endothermic peak attending on melting of a crystal, which is detected in the course of heating the sample from −50° C. to 280° C. [corresponding to a temperature near (the crystalline melting point (Tm)+60.degree. C.)] at a heating rate of 20° C./min under a nitrogen atmosphere. When a plurality of endothermic peaks is observed, a temperature of a peak having the largest peak area is regarded as a crystalline melting point (Tm).

The polyglycolic acid can have a glass transition temperature (Tg) of from a low of about 25° C., about 30° C., about 35° C., or about 40° C. to a high of about 45° C., about 50° C., about 55° C., or about 60° C. The polylactic acid can have a glass transition temperature (Tg) of from a low of about 45° C., about 50° C., about 55° C., or about 60° C. to a high of about 65° C., about 70° C., or about 75° C. The glass transition temperature (Tg) of the aliphatic polyester can be controlled or adjusted by, for example, the weight average molecular weight (Mw), the molecular weight distribution, and/or the presence of and/or amount of one or more copolymerization components. The glass transition temperature (Tg) of the aliphatic polyester can be determined under the nitrogen atmosphere by means of the differential scanning calorimeter (DSC), similar to the measurement of the crystalline melting point (Tm). More particularly, an intermediate point between a start temperature and an end temperature in transition from a glassy state to a rubbery state when a non-crystalline sample obtained by heating an aliphatic polyester sample to about 280° C. [near (the crystalline melting point (Tm)+60° C.)], holding the sample for 2 minutes at this temperature and then quickly, e.g., at a rate of about 100° C./min) cooling the sample with liquid nitrogen is reheated from a temperature near room temperature to a temperature near 100° C. at a heating rate of 20° C./min under the nitrogen atmosphere by means of the DSC is regarded as a glass transition temperature (Tg).

A rate of single-sided decomposition from thermal stress alone for the polyglycolic acid can be estimated according to the following equation:

$$\Delta mm=-0.5e^{23.654-9443/K}$$

Accordingly, the rate of single-sided decomposition for the component made from polyglycolic acid, e.g., the ball 425, 623, and/or 643, and/or the flapper member 310, can be estimated based on a known environmental temperature around the plug 600. The rate of degradation for the component made from polyglycolic acid can also be adjusted, controlled, or otherwise influenced by adjusting or controlling the environmental temperature around where the plug 600 is located.

The aliphatic polyester can also include one or more additives. The one or more additives can be mixed, blended, stirred, reacted, or otherwise combined with the aliphatic polyester and/or the monomer components reacted to form the aliphatic polyester. Illustrative additives can include, but are not limited to, one or more thermal stabilizers, one or more catalyst-deactivating agents, one or more fillers, one or more carboxyl group capping agents, one or more calcium-containing inorganic compounds, e.g., the carbonate, hydroxide, and/or phosphate of calcium, one or more plasticizers, one or more pigments or colorants, one or more nucleating agents, one or more light stabilizers, one or more lubricants, any combination thereof, or any mixture thereof.

Illustrative carboxyl group capping agents can include, but are not limited to, carbodiimide compounds, e.g., monocarbodiimides and polycarbodiimides such as N,N-2,6-diisopropylphenylcarbodiimide; oxazoline compounds, e.g., 2,2'-m-phenylene-bis(2-oxazoline), 2,2'-p-phenylene-bis(2-oxazoline), 2-phenyl-2-oxagoline, and styrene-isopropenyl-2-oxazoline; oxazine compounds, e.g., 2-methoxy-5,6-dihydro-4H-1,3-oxazine; and epoxy compounds, e.g., N-glycidylphthalimide, cyclohexene oxide, and tris (2,3-epoxypropyl)isocyanurate. In at least one embodiment, if the carboxyl group capping agent is present, the carboxyl group capping agent can be or include one or more carbodiimide compounds and/or epoxy compounds. Illustrative thermals stabilizers can include, but are not limited to, phosphoric acid esters having a pentaerythritol skeleton and alkyl phosphate or phosphite esters having an alkyl group of preferably 8-24 carbon atoms.

If one or more additives are combined with the aliphatic polyester, the amount of each additive can range from a low of about 0.01 wt % to a high of 50 wt %, based on the total weight of the aliphatic polyester. For example, the amount of any given additive can range from a low of about 0.01 wt %, about 0.05 wt %, about 0.1 wt %, about 0.5 wt %, or about 1 wt % to a high of about 3 wt %, about 5 wt %, about 7 wt %, or about 9 wt %, based on the total weight of the aliphatic polyester.

Commercially available polyglycolic acids can include, but are not limited to, TLF-6267, which is available from DuPont; and the KUREDUX® and KURESURGE® polyglycolic acids available from Kureh Corporation. Specific examples of polyglycolic acids available from Kureh Corporation include the KUREDUX® grades 100E35, 100R60, and 100T60. Commercially available polylactic acids can include, but are not limited to, the LACEA® polylactic acids sold under the names LACEA® H-100, LACEA® H-280, LACEA® H-400, and LACEA® H-440, which are available from Mitsui Chemicals, Inc.; the INGEO® polylactic acids sold under the names INGEO® 3001D, INGEO® 3051D, INGEO® 4032D, INGEO® 4042D, INEGEO® 4060D, INGEO® 6201D, INGEO® 6251D, INGEO® 7000D, and INGEO® 7032D, which are available from Nature Works LLC; the Eco Plastic U'z polylactic acids sold under the names Eco Plastic U'z S-09, Eco Plastic U'z S-12, and Eco Plastic U'z S-17, which are available from the Toyota Motor Corporation; and the VYLOECOL® line of polylactic acids, which are available from TOYOBO CO., LTD.

Additional details of the aliphatic polyesters and/or components used to produce the aliphatic polyesters are discussed and described in U.S. Pat. Nos. 5,688,586; 5,853,639; 5,908, 917; 6,001,439; 6,046,251; 6,159,416; 6,183,679; 6,245,437; 6,673,403; 6,852,827; 6,891,048; 6,916,939; 6,951,956; 7,235,673; 7,501,464; 7,538,178; 7,538,179; 7,622,546; 7,713,464; 7,728,100; 7,781,600; 7,785,682; 7,799,837; 7,812,181; 7,976,919; 7,998,385; 8,003,721; 8,039,548; 8,119,699; 8,133,955; 8,163,866; 8,230,925; 8,293,826; 8,304,500; 8,318,837; 8,362,158; 8,404,868; and 8,424,610; U.S. Patent Application Publication Nos.: 2005/0175801; 2006/0047088; 2009/0081396; 2009/0118462; 2009/0131602; 2009/0171039; 2009/0318716; 2010/0093948; 2010/0184891; 2010/0286317; 2010/0215858; 2011/0008578; 2011/0027590; 2011/0104437; 2011/0108185; 2011/0190456; 2011/0263875; 2012/0046414; 2012/0086147; 2012/0130024; 2012/0156473; 2012/0193835; 2012/0270048; 2012/0289713; 2013/0079450; 2013/0087061; 2013/0081813; 2013/0081801; and WO Publication Nos.: WO2002/070508; WO2002/083661; WO2003/006525; WO2003/006526; WO2003/037956; WO2003/074092; WO2003/090438; WO2003/099562; WO2004/033527; WO2005/044894; WO2006/064611.

In one specific embodiment, the ball 425, 623, 643 can be made from the one or more decomposable materials or at least partially made from the one or more decomposable materials. The ball 425, 623, 643 can be made homogenous or the ball 425, 623, 643 can be made of multiple layers where each layer is made of the same or different materials, and where at least one layer is made from the one more decomposable materials. For example, the ball 425, 623, 643 can have a core and any number of discrete layers surrounding the core, where the core or any of the discrete layers is made from the one or more decomposable materials. Any number of discrete layers can be used depending on the size of the ball 425, 623, 643 and the thickness of the individual layers. For example, the number of discrete layers can range from a low of 1, 5, or 10 to a high of 10, 20, or 50.

The core and any one or more layers in a multi-layer component can be formed or made from the same decomposable material or composition. Similarly, the core and any one or more layers in a multi-layer component can be formed or made from different decomposable materials or compositions. In one specific embodiment, a first layer of the ball 425, 623, 643 can be made of a first decomposable material and the core of the ball 425, 623, 643 can be made of a second decomposable material, where the first and second decomposable materials have different predetermined triggers, e.g., the first and second predetermined triggers can be or can include different temperatures. Said another way, the first layer of the ball 425, 623, 643 can be made of a first decomposable material and the core of the ball 425, 623, 643 can be made of a second decomposable material, where the first and second decomposable materials undergo different rates of at least partial decomposition, degradation, degeneration, melting, combustion, softening, decay, break up, break down, dissolving, disintegration, breaking, dissociation, reduction into smaller pieces or components, or otherwise falls apart when exposed to the same predetermined trigger. Any of the other component(s), including any of the body, rings, slips, conical members or cones, malleable and/or sealing elements, shoes, other impediments, e.g., impediment 445, flapper member 310, anti-rotation features, inserts, etc., of the plug 600 can be made the same way as the ball 425, 623, 643.

Certain embodiments and features have been described using a set of numerical upper limits and a set of numerical lower limits It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A plug for isolating a wellbore, comprising:
- a mandrel having a bore formed therethrough;
- at least one sealing element about the mandrel;
- at least one slip about the mandrel;
- at least one conical member about the mandrel;
- a shear element for engaging a setting tool, wherein the shear element releases the setting tool from the plug when exposed to a predetermined force;
- an insert at least partially within the bore between an upper end of the mandrel and the sealing element, the insert comprising:
  - a body having a bore formed completely therethrough and adapted to receive an impediment that restricts fluid flow in at least one direction through the body or a bore formed only partially therethrough, and wherein at least one of the body and the impediment comprises one or more decomposable materials;
  - at least one circumferential groove on an outer surface of the body, wherein the at least one circumferential groove is adapted to retain an elastomeric seal; and
  - one or more threads on the outer surface of the body for securing the insert into the mandrel.

2. The plug of claim 1, wherein the decomposable material comprises one or more aliphatic polyesters.

3. The plug of claim 2, wherein the one or more aliphatic polyesters is selected from the group consisting of: polyglycolic acid, polylactic acid, and a copolymer containing a repeating unit derived from a reaction product of glycolic acid and lactic acid.

4. The plug of claim 2, wherein the aliphatic polyester comprises polyglycolic acid.

5. The plug of claim 4, wherein the bore of the body is formed partially therethrough to block fluid flow in both axial directions through the insert.

6. The plug of claim 2, wherein the aliphatic polyester comprises a homopolymer containing a repeating unit derived from glycolic acid in an amount of at least 50 wt %, based on the total weight of the aliphatic polyester.

7. The plug of claim 2, wherein the aliphatic polyester comprises a homopolymer containing a repeating unit derived from lactic acid in an amount of at least 50 wt %, based on the total weight of the aliphatic polyester.

8. The plug of claim 2, wherein the aliphatic polyester comprises a copolymer containing a repeating unit derived from a reaction product of glycolic acid and lactic acid in an amount of at least 50 wt %, based on the total weight of the aliphatic polyester.

9. The plug of claim 1, wherein the decomposable material at least partially decomposes, degrades, degenerates, melts, combusts, softens, decays, breaks up, breaks down, dissolves, disintegrates, decomposes, breaks, or dissociates when exposed to one or more predetermined triggers, and wherein the predetermined trigger comprises heating the decomposable material to a temperature of about 200° F. or more.

10. The plug of claim 1, wherein the decomposable material at least partially decomposes, degrades, degenerates, melts, combusts, softens, decays, breaks up, breaks down, dissolves, disintegrates, decomposes, breaks, or dissociates when exposed to one or more predetermined triggers, and wherein the predetermined trigger comprises contacting the decomposable material with water.

11. The plug of claim 1, wherein the decomposable material at least partially decomposes, degrades, degenerates, melts, combusts, softens, decays, breaks up, breaks down, dissolves, disintegrates, decomposes, breaks, or dissociates when exposed to one or more predetermined triggers, and wherein the predetermined trigger comprises contacting the decomposable material with one or more acids, one or more bases, or one or more neutral compounds.

12. The plug of claim 1, wherein the one or more threads on the outer surface of the body are adapted to engage one or more threads on an inner surface of the mandrel.

13. The plug of claim 12, wherein the insert remains at least partially within the bore of the mandrel after the shear element shears and releases the setting tool.

14. The plug of claim 13, wherein the bore of the body is formed completely therethrough.

15. The plug of claim 13, wherein the setting tool comprises an adapter rod, an outer cylinder, or both.

16. A plug for isolating a wellbore, comprising:
- a mandrel having a bore formed therethrough;
- at least one sealing element about the mandrel;
- at least one slip about the mandrel;
- at least one conical member about the mandrel;
- a shear element for engaging a setting tool, wherein the shear element releases the setting tool from the plug when exposed to a predetermined force; and
- an insert at least partially within the bore of the mandrel between the shear element and the sealing element, the insert comprising:
  - a body having a bore formed completely therethrough, wherein a shoulder is formed on an inner surface of the body;
  - a ball within the bore of the body, wherein the ball is adapted to block fluid flow in at least one direction through the bore of the body and the bore of the mandrel when the ball is in contact with the shoulder;
  - a ball stop within the bore of the body, wherein the ball is between the shoulder and the ball stop, and wherein the ball, the ball stop, or both comprises a decomposable material;
  - at least one circumferential groove on an outer surface of the body, wherein the at least one circumferential groove is adapted to retain an elastomeric seal; and
  - one or more threads on the outer surface of the body for securing the insert into the mandrel.

17. The plug of claim 16, wherein the decomposable material comprises one or more aliphatic polyesters.

18. The plug of claim 17, wherein the one or more aliphatic polyesters is selected from the group consisting of: polyglycolic acid, polylactic acid, and a copolymer containing a repeating unit derived from a reaction product of glycolic acid and lactic acid.

19. A plug for isolating a wellbore, comprising:
- a mandrel having a bore formed therethrough;
- a shear element for engaging a setting tool, wherein the shear element releases the setting tool from the plug when exposed to a predetermined force;
- at least one sealing element about the mandrel;
- at least one slip about the mandrel;
- at least one conical member about the mandrel;
- at least one anti-rotation feature on a first end of the plug, a second end of the plug, or both ends of the plug; and
- an insert at least partially within the bore of the mandrel between the shear element and the sealing element, the insert comprising:
  - a body having a bore formed completely therethrough or a bore formed only partially therethrough, and wherein the body comprises one or more decomposable materials;
  - at least one circumferential groove on an outer surface of the body;
  - an elastomeric seal within the at least one circumferential groove; and
  - one or more threads on the outer surface of the body that are adapted to engage one or more threads on an inner surface of the mandrel;
- wherein the insert remains at least partially within the bore of the mandrel after the shear element shears and releases the setting tool.

20. The plug of claim 19, wherein the decomposable material comprises one or more polyglycolic acids, polylactic acids, or any combination thereof.

21. The plug of claim 20, wherein the decomposable material comprises a homopolymer containing a repeating unit derived from glycolic acid in an amount of at least 50 wt %, based on the total weight of the aliphatic polyester.

22. The plug of claim 19, wherein the setting tool comprises an adapter rod, an outer cylinder, or both.

23. A plug for isolating a wellbore, comprising:
- a mandrel having a bore formed therethrough;
- at least one sealing element about the mandrel;
- at least one slip about the mandrel;
- at least one conical member about the mandrel;
- at least one shear element proximate an upper portion of the mandrel for engaging a setting tool, wherein the shear element releases the setting tool from the plug when exposed to a predetermined force;
- an insert at least partially within the bore between the upper portion of the mandrel and the sealing element, the insert comprising:
  - a body having a bore formed at least partially therethrough, wherein the body comprises one or more decomposable materials;
  - at least one circumferential groove on an outer surface of the body, wherein the at least one circumferential groove is adapted to retain an elastomeric seal; and
  - one or more threads on the outer surface of the body for securing the insert into the mandrel.

24. The plug of claim 23, wherein the one or more threads on the outer surface of the body are adapted to engage one or more threads on an inner surface of the mandrel.

25. The plug of claim 23, wherein the insert remains at least partially within the bore of the mandrel after the at least one shear element shears and releases the setting tool.

26. The plug of claim 23, wherein the at least one shear element is integral with the mandrel or a separate component that is adapted to engage the mandrel.

27. The plug of claim 23, wherein the mandrel is made of one or more composite materials.

28. The plug of claim 23, further comprising at least one anti-rotation feature on an upper end of the plug, a lower end of the plug, or both ends of the plug.

29. The plug of claim 23, wherein the setting tool comprises an adapter rod, an outer cylinder, or both.

30. The plug of claim 23, wherein the insert is blocked thereby preventing fluid flow through the bore of the mandrel in both axial directions.

31. The plug of claim 23, wherein the at least one shear element comprises one or more shear threads, shear screws, shear pins, or combinations thereof.

* * * * *